US008168365B2

(12) United States Patent
Ozawa et al.

(10) Patent No.: US 8,168,365 B2
(45) Date of Patent: May 1, 2012

(54) METHOD FOR MANUFACTURING ELECTROPHOTOGRAPHIC PHOTOSENSITIVE MEMBER

(75) Inventors: Tomohito Ozawa, Mishima (JP); Kazuyoshi Akiyama, Mishima (JP); Yuu Nishimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 461 days.

(21) Appl. No.: 12/505,698

(22) Filed: Jul. 20, 2009

(65) Prior Publication Data

US 2010/0021837 A1 Jan. 28, 2010

(30) Foreign Application Priority Data

Jul. 25, 2008 (JP) ..... 2008-192057
Jul. 7, 2009 (JP) ..... 2009-160400

(51) Int. Cl.
*G03G 5/147* (2006.01)

(52) U.S. Cl. ..... 430/132; 430/66; 430/57.4

(58) Field of Classification Search ..... 430/132, 430/66, 57.4
See application file for complete search history.

(56) References Cited

U.S. PATENT DOCUMENTS 4,460,669 A * 7/1984 Ogawa et al. ..... 430/57.7
4,495,262 A * 1/1985 Matsuzaki et al. ..... 430/57.5
4,569,855 A 2/1986 Matsuda et al.
4,683,144 A 7/1987 Nishimura et al.
4,683,145 A 7/1987 Nishimura et al.
4,683,146 A 7/1987 Hirai et al.
4,683,147 A 7/1987 Eguchi et al.
4,696,881 A * 9/1987 Saitoh et al. ..... 430/57.7
4,769,303 A * 9/1988 Ueno et al. ..... 430/67
5,455,138 A 10/1995 Okamura et al.
5,582,944 A 12/1996 Yamamura et al.
5,817,181 A 10/1998 Okamura et al.
7,338,738 B2 * 3/2008 Kojima et al. ..... 430/57.4
7,381,510 B2 * 6/2008 Akiyama et al. ..... 430/133
7,498,110 B2 3/2009 Tanigchi et al.

FOREIGN PATENT DOCUMENTS

JP 9-204056 8/1997
JP 2002-123020 4/2002

* cited by examiner

*Primary Examiner* — Christopher Rodee
(74) *Attorney, Agent, or Firm* — Fitzpatrick, Cella, Harper & Scinto

(57) ABSTRACT

The present invention provides a method for manufacturing an electrophotographic photosensitive member including a step of forming a first surface layer and a second surface layer of the electrophotographic photosensitive member by supplying a source gas into a reaction vessel so that $C^2/S^2$, which are respectively flow rates of $CH_4$ and $SiH_4$ flowing when the second surface layer is formed, can be 3 or more and 25 or less, and $C^1/S^1$, which are respectively flow rates of $CH_4$ and $SiH_4$ flowing when the first surface layer is formed, can be $C^2/S^2$ or more but 60 or less. The method includes an additional step of adjusting the high-frequency power so that $P^2>P^1$ can be satisfied, which are high-frequency powers respectively when the second surface layer is formed and when the first surface layer is formed, and C/(Si+C) of the first surface layer and C/(Si+C) of the second surface layer can be 0.50 or more and 0.80 or less.

6 Claims, 6 Drawing Sheets

METHOD FOR MANUFACTURING ELECTROPHOTOGRAPHIC PHOTOSENSITIVE MEMBER

BACKGROUND OF THE INVENTION

1. Field of the Invention

The present invention relates to a method for manufacturing an electrophotographic photosensitive member (hereinafter referred to as "a-Si photosensitive member" as well) having a photoconductive layer (hereinafter referred to as "a-Si photoconductive layer" as well) formed from amorphous silicon (hereinafter referred to as "a-Si" as well), which can be applied to an image-forming apparatus (electrophotographic apparatus) using an electrophotographic process such as a copying machine, a printer and a facsimile.

2. Description of the Related Art

An electrophotographic photosensitive member is widely known, which is made by forming a photoconductive layer (photosensitive layer) consisting of an amorphous material on a conductive substrate (hereinafter referred to as merely "substrate" as well). An a-Si photosensitive member has already been commercialized, which has a photoconductive layer formed on the substrate such as metal with a film-forming technology (layer-forming technology) such as a chemical vapor deposition method (CVD method) and a physical vapor deposition method (PVD method), in particular.

The structure of a positively chargeable a-Si photosensitive member 5000 as illustrated in FIG. 5A and the structure of a negatively chargeable a-Si photosensitive member 5100 as illustrated in FIG. 5B are known as basic structures of the above described a-Si photosensitive member.

The positively chargeable a-Si photosensitive member 5000 has a layer structure of forming a light receiving layer 5002 formed from a-Si on a conductive substrate 5001, and further stacking a surface layer 5005 thereon which is formed from hydrogenated amorphous silicon carbide (hereinafter referred to as "a-SiC" as well). The light receiving layer 5002 may also have a stacked structure of a lower electric-charge injection preventing layer 5003 and a photoconductive layer 5004.

The negatively chargeable a-Si photosensitive member 5100 has a layer structure of forming a light receiving layer 5102 formed from a-Si on a conductive substrate 5101 and further stacking a surface layer 5105 thereon which is formed from a-SiC. The light receiving layer 5102 may also have a stacked structure of a lower electric-charge injection preventing layer 5103, a photoconductive layer 5104 and an upper electric-charge injection preventing layer 5110.

An a-SiC surface layer has been mainly used in an electrophotographic apparatus with a fast processing speed because of having a superior abrasion resistance. However, a surface layer conventionally formed from a-SiC (hereinafter referred to as "a-SiC surface layer" as well) has occasionally caused a problem that when used in an environment of high absolute humidity, letters are blurred or the letters form a blank area without being printed (hereinafter referred to as "high-humidity flow").

The high-humidity flow (or image flow or image deletion due to high-humidity) means a phenomenon as will be described below.

Specifically, the high-humidity flow occurs when an image has been output with the use of an electrophotographic apparatus placed in the environment of high absolute humidity and an image is output again after a while, and indicates such an image failure shown in the latter output image that letters are blurred or form a blank area without being printed.

This high-humidity flow is considered to be caused by a phenomenon that the surface resistance decreases due to moisture adsorbed on the surface of the electrophotographic photosensitive member and electric charges flow transversely. Therefore, the high-humidity flow more easily occurs when the electrophotographic apparatus is placed in the environment of high absolute humidity or does not have a heater for heating the photosensitive member provided in the vicinity of the a-Si photosensitive member. Accordingly, in order to inhibit the occurrence of this high-humidity flow, it has been carried out to reduce or remove an electrification product or moisture, which has been adsorbed on by the surface of the electrophotographic photosensitive member and is considered to cause the high-humidity flow, by always heating an electrophotographic photosensitive member with the use of the heater for heating the photosensitive member.

In contrast to this, a large number of electrophotographic processes are conventionally proposed in order to inhibit the high-humidity flow with other methods than using a heater for heating the photosensitive member.

On the other hand, there are proposed a large number of a-Si photosensitive members and manufacturing methods therefor, which aim at inhibiting the high-humidity flow by reducing the adsorption of an electrification product or moisture and enhancing the removal efficiency.

Japanese Patent Application Laid-Open No. H09-204056 discloses a technology of controlling a surface layer made from a-SiC which is stacked on a photoconductive layer and is expressed by a composition formula of a-$Si_{1-x}C_x$:H so as to have an element ratio of $0.95 \leqq x \leqq 1.00$ when expressed by the value x, and controlling a dynamic pushing hardness of the free surface to 45 to 220 kgf/$mm^2$.

According to this technology, the surface layer acquires low hardness by controlling the value x to 0.95 or more, and becomes easily abraded. As a result, an adsorbed material such as an electrification product and moisture adsorbed on the surface of the surface layer together with an oxidation modified part on the surface can be removed, and accordingly the high-humidity flow can be inhibited.

Japanese Patent Application Laid-Open No. 2002-123020 discloses a technology of composing the surface layer of a negatively chargeable a-Si photosensitive member having an a-Si photoconductive layer and an a-SiC surface layer sequentially stacked on a substrate so as to make carbon atoms in the surface layer ununiformly distributed in a stacked direction and give the content of the carbon atoms a local maximum value in a region except the surface.

According to this technology, a light career is recombined with a surface charge in the vicinity of the top surface side of a region in which the content of the carbon atoms becomes maximum, so that the recombination is not affected by the electrification product adsorbed on the surface, which can inhibit the high-humidity flow.

In recent years, in the market, the printing process is changed to an electrophotographic process in which the surface layer is further easily abraded compared to a conventional electrophotographic process along with the tendency of the speedup and colorization of an electrophotographic apparatus. Along with the tendency of the speedup and colorization, an electrophotographic apparatus is also required which can stably output an image of high quality. Furthermore, the market shows a keen interest in an environmental problem, and the electrophotographic apparatus is also required to have enhanced energy-saving properties by decreasing an electric power consumption.

For these market requests, the electrophotographic apparatus itself needs to be improved as well. At the same time, an electrophotographic photosensitive member is also required to have an improved high-humidity flow while maintaining adequate abrasion resistance and further have superior energy-saving properties as well.

However, the technology in Japanese Patent Application Laid-Open No. H09-204056 has needed a certain amount or more of abrasion so as to remove an oxidized layer formed on the surface of the electrophotographic photosensitive member and an adsorbed material which causes the high-humidity flow and is represented by moisture and the electrification product adsorbed on this oxidized layer, in order to inhibit the occurrence of the high-humidity flow.

When the technology in Japanese Patent Application Laid-Open No. H09-204056 is not used, the electrophotographic photosensitive member has enabled the high-humidity flow to be inhibited while controlling the abrasion amount, by making a heater for heating the photosensitive member provided in the vicinity of the electrophotographic photosensitive member, and thereby removing the moisture adsorbed on the surface of the electrophotographic photosensitive member.

However, the heater for heating the photosensitive member needs a large amount of an electric power, so that when the heater for heating the photosensitive member is used, it is difficult to reduce the power consumption.

From the above description, it has been a very difficult problem for a conventional electrophotographic photosensitive member and electrophotographic apparatus to realize both of enhancing the abrasion resistance and reducing the power consumption while inhibiting the high-humidity flow.

In addition, it is extremely important for the a-SiC surface layer to inhibit the oxidation of the a-SiC surface layer, which affects the adsorptivity for the adsorbed material, in order to inhibit the high-humidity flow. The a-SiC surface layer also needs to enhance its hardness in order to enhance its abrasion resistance. Therefore, it is necessary to enhance the denseness of a-SiC itself which forms the surface layer, in order to inhibit the high-humidity flow and simultaneously enhance the abrasion resistance.

It is considered as a method of preparing an a-SiC surface layer having such high denseness to promote the decomposition of a source gas. As for its specific technique, it is considered to increase a high-frequency power to be introduced into a reaction vessel compared to a conventional technique, or to reduce an amount of the source gas to be supplied.

However, there is a case in which the ratio of a number of atoms of carbon atoms with respect to the sum of the number of atoms of silicon atoms and the carbon atoms in the surface layer (hereinafter referred to as "C/(Si+C)" increases when the high-frequency power to be introduced into the reaction vessel is simply increased compared to the conventional technique, and the light absorption at the a-SiC surface layer increases. In such a case, an amount of an image-exposing light necessary for forming an electrostatic latent image increases, and the sensitivity is lowered.

There is also a case in which the C/(Si+C) in the surface layer increases even when the amount of $SiH_4$ to be supplied is extremely decreased, and the sensitivity is lowered by the increase of the light absorption.

On the other hand, when the amount of $CH_4$ to be supplied is extremely reduced, the resistance of the a-SiC surface layer decreases, and accordingly a carrier easily causes a transverse flow in the surface layer when the electrostatic latent image is formed. Therefore, when isolated dots are formed for the electrostatic latent image, the isolated dots become small due to the transverse flow of the carrier in the surface layer. As a result, an image concentration decreases particularly in a low concentration side of an output image, so that there is a case in which the gradation properties decreased.

In addition, there is a case in which hydrogen atoms are overly reduced in the surface layer by an excessive decomposition of the source gas depending on a manufacturing condition, even when the C/(Si+C) of the a-SiC surface layer is controlled to an appropriate range. In such a case, it becomes difficult to keep the sensitivity adequate.

As was described above, it has been very difficult to prepare the a-SiC surface layer having all of high-humidity flow, an abrasion amount, gradation properties and sensitivity controlled to an adequate state, and the realization technique has not been found.

SUMMARY OF THE INVENTION

An object of the present invention is to provide the above described realization technique. Specifically, an object of the present invention is to provide a method for manufacturing an electrophotographic photosensitive member having superior characteristics of the electrophotographic photosensitive member, which realizes the inhibition of a high-humidity flow by reducing the adsorption of moisture and an electrification product on the surface of the electrophotographic photosensitive member, while enhancing abrasion resistance by enhancing the hardness and reducing energy consumption.

The present invention provides a method for manufacturing an electrophotographic photosensitive member, which mounts a conductive substrate in a reaction vessel that can be evacuated, supplies a source gas into the reaction vessel and introduces a high-frequency power to form a deposited film on the conductive substrate including in the following order: forming a photoconductive layer formed from an amorphous material containing silicon atoms on the conductive substrate; forming a first surface layer formed from an amorphous material containing silicon atoms and carbon atoms; and forming a second surface layer formed from an amorphous material containing silicon atoms and carbon atoms as a layer in a top surface side of the electrophotographic photosensitive member, wherein when flow rates of $CH_4$ and $SiH_4$ to be supplied into the reaction vessel in forming the first surface layer are defined as $C^1$ and $S^1$ and a high-frequency power to be introduced into the reaction vessel is defined as $P^1$, and when flow rates of $CH_4$ and $SiH_4$ to be supplied into the reaction vessel in forming the second surface layer are defined as $C^2$ and $S^2$ and a high-frequency power to be introduced into the reaction vessel is defined as $P^2$, the first surface layer and the second surface layer are formed while supplying the source gas into the reaction vessel so that $C^2/S^2$ is 3 or more and 25 or less and $C^1/S^1$ is $C^2/S^2$ or more and 60 or less, and while adjusting the high-frequency power so that $P^2>P^1$ can be satisfied, and so that both a ratio of the number of atoms of the carbon atoms with respect to the sum of the number of atoms of the silicon atoms and the carbon atoms contained in the first surface layer and the ratio of the number of atoms of the carbon atoms with respect to the sum of the number of atoms of the silicon atoms and the carbon atoms contained in the second surface layer can be 0.50 or more and 0.80 or less.

The present invention can provide a method for manufacturing an electrophotographic photosensitive member having superior characteristics of the electrophotographic photosensitive member, which realizes the inhibition of a high-humidity flow by reducing the adsorption of moisture and an electrification product on the surface of the electrophotographic photosensitive member, while enhancing abrasion resistance and reducing energy consumption by enhancing the hardness.

Thereby, the present invention can provide an electrophotographic photosensitive member which can realize an electrophotographic apparatus that excellently inhibits the high-humidity flow, enhances the abrasion resistance and enhances the energy-saving properties.

Further features of the present invention will become apparent from the following description of exemplary embodiments with reference to the attached drawings.

DESCRIPTION OF THE EMBODIMENTS

The present invention provides a method for manufacturing an electrophotographic photosensitive member having a surface layer which can inhibit a high-humidity flow by reducing the adsorption of moisture and an electrification product on the surface of the electrophotographic photosensitive member, can reduce an abrasion amount by enhancing the hardness, can enhance sensitivity by reducing light absorption and can enhance gradation properties by inhibiting the electric resistance from being lowered.

The present inventors made an extensive investigation, and as a result, found it effective to separate a surface layer into two layers of a layer adapted for enhancing the high-humidity flow and durability and a layer for keeping optical and electrical characteristics. The present inventors also have found that these two layers can be stacked by controlling the amount of a source gas to be supplied and the amount of a high-frequency power to be introduced to a predetermined range while maintaining the C/(Si+C) in each layer to a predetermined range when each layer is formed, without causing other adverse effects, and have accomplished the present invention.

Embodiments according to the present invention will now be described in detail with reference to the drawings.

Figure 1A:
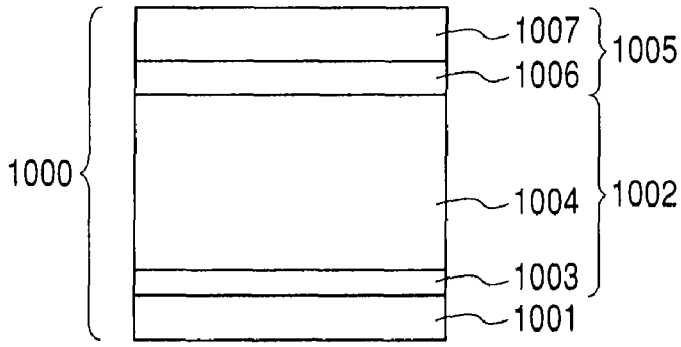
FIGS. 1A, 1B and 1C are schematic block diagrams for describing a layer structure of an electrophotographic photosensitive member (positively chargeable a-Si photosensitive member) which has been manufactured with a manufacturing method of the present invention.
Figure 1B:
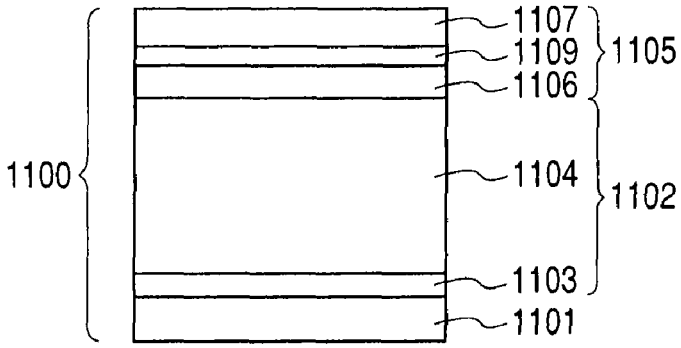
Figure 1C:
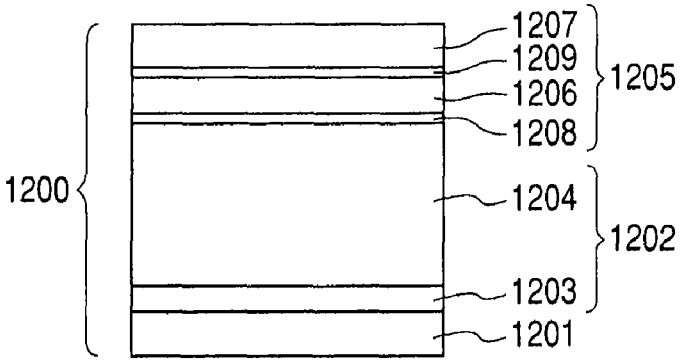

FIGS. 1A, 1B and 1C are schematic block diagrams for describing a layer structure of an electrophotographic photosensitive member (positively chargeable a-Si photosensitive member) which has been manufactured with a manufacturing method according to the present invention.

A positively chargeable a-Si photosensitive member 1000 in FIG. 1A has a light receiving layer 1002 and a surface layer 1005 provided on a conductive substrate 1001, in this order. The light receiving layer 1002 has a lower electric-charge injection preventing layer 1003, which is made from silicon atoms of a base material (lower electric-charge injection preventing layer formed from amorphous material containing silicon atom) and a photoconductive layer 1004 which is made from silicon atoms of a base material (photoconductive layer formed from amorphous material containing silicon atom), provided in this order. The surface layer 1005 has a first surface layer 1006 made from silicon atoms and carbon atoms of a base material (first surface layer formed from amorphous material containing silicon atom and carbon atom) and a second surface layer 1007 made from silicon atoms and carbon atoms of a base material (second surface layer formed from amorphous material containing silicon atom and carbon atom), provided in this order.

Figure 2:
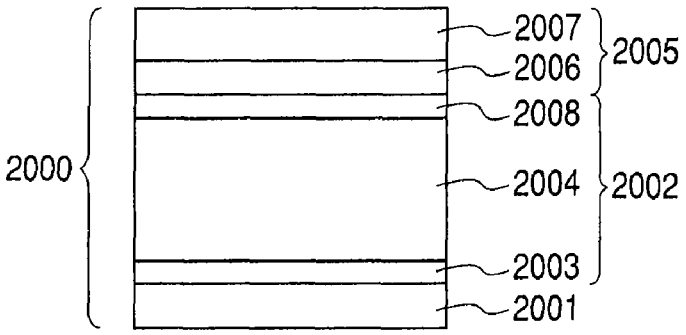
FIG. 2 is a schematic block diagram for describing a layer structure of an electrophotographic photosensitive member (negatively chargeable a-Si photosensitive member) which has been manufactured with a manufacturing method of the present invention.

FIG. 2 is a schematic block diagram for describing a layer structure of an electrophotographic photosensitive member (negatively chargeable a-Si photosensitive member) which has been manufactured with a manufacturing method according to the present invention.

A negatively chargeable a-Si photosensitive member 2000 in FIG. 2 has a light receiving layer 2002 and a surface layer 2005 provided on a conductive substrate 2001, in this order. The light receiving layer 2002 has a lower electric-charge injection preventing layer 2003, a photoconductive layer 2004 and an upper electric-charge injection preventing layer 2008 provided in this order. The surface layer 2005 has a first surface layer 2006 which is made from silicon atoms and carbon atoms of a base material (first surface layer formed from amorphous material containing silicon atoms and carbon atoms) and a second surface layer 2007 which is made from silicon atoms and carbon atoms of a base material (second surface layer formed from amorphous material containing silicon atom and carbon atom), provided in this order.

In the present invention, the surface layer has a two-layer structure in which the second surface layer in the top surface side of the electrophotographic photosensitive member has functions of inhibiting a high-humidity flow and enhancing durability, and the first surface layer in a photoconductive layer side has a function for keeping optical and electrical characteristics.

In order to make each of the functions of the first surface layer and the second surface layer appear, the first surface layer and the second surface layer need to be prepared so as to satisfy film-forming conditions (layer (deposited film) forming condition), which will be described below. Thereby, an electrophotographic photosensitive member superior in the high-humidity flow, abrasion amount, gradation properties and sensitivity can be prepared.

In the present invention, when flow rates of $CH_4$ and $SiH_4$ to be supplied into the reaction vessel in forming the first surface layer are defined as $C^1$ and $S^1$ and a high-frequency power to be introduced into the reaction vessel is defined as $P^1$, and when flow rates of $CH_4$ and $SiH_4$ to be supplied into the reaction vessel in forming the second surface layer are defined as $C^2$ and $S^2$ and a high-frequency power to be introduced into the reaction vessel is defined as $P^2$, a source gas is supplied to the reaction vessel so that $C^2/S^2$ is 3 or more and 25 or less and $C^1/S^1$ is $C^2/S^2$ or more and 60 or less, and the high-frequency power to be introduced into the reaction vessel is adjusted so that $P^2>P^1$ can be satisfied, and so that both a ratio (C/(Si+C)) of a number of atoms of carbon atoms with respect to the sum of number of atoms of silicon atoms and carbon atoms contained in the first surface layer and a ratio (C/(Si+C)) of the number of atoms of carbon atoms with respect to the sum of the number of atoms of silicon atoms and carbon atoms contained in the second surface layer can be 0.50 or more and 0.80 or less.

By increasing the high-frequency power to be introduced into the reaction vessel and reducing the source gas to be supplied into the reaction vessel, the decomposition of $CH_4$ is promoted which is more hardly decomposed than a source gas, $SiH_4$ to be supplied into the reaction vessel. Thereby, active species containing a few hydrogen atoms are formed, and hydrogen atoms in the deposited film formed on a substrate decrease, so that a dense a-SiC surface layer can be formed.

It is considered that an a-SiC with such high denseness makes silicon atoms and carbon atoms networked to each other, and decreases an end group having many hydrogen atoms such as a methyl group, so that a structural distortion is decreased. Accordingly, ion species to be formed in an electrification step are reduced and an oxidation reaction of the a-SiC surface layer is inhibited, which decreases the adsorption amount of moisture and an electrification product on the surface of the electrophotographic photosensitive member and can inhibit the high-humidity flow.

At the same time, the surface layer acquires an enhanced hardness by networking the silicon atoms and the carbon atoms and decreasing the structural distortion, and accordingly the abrasion amount can be reduced. Therefore, by controlling a high-frequency power to be introduced in the step of forming the second surface layer in the top surface side of the electrophotographic photosensitive member to be larger than that in the step of forming the first surface layer, while supplying the source gas into the reaction vessel so that the ratio $C^2/S^2$ of the flow rate of $CH_4$ with respect to the flow rate of $SiH_4$ to be supplied in the step of forming the second surface layer can be 25 or less, the electrophotographic photosensitive member can make the top surface side obviously show the effects of inhibiting the high-humidity flow and reducing the abrasion amount.

On the other hand, by substantially increasing the high-frequency power to be introduced into the reaction vessel, the hydrogen atoms in the a-SiC surface layer are reduced and the sensitivity tends to be easily aggravated. Therefore, by controlling a high-frequency power to be introduced in the step of forming the first surface layer in the photoconductive layer side to be smaller than that in the step of forming the second surface layer, while supplying the source gas into the reaction vessel so that the ratio $C^2/S^2$ of the flow rate of $CH_4$ with respect to the flow rate of $SiH_4$ to be supplied in the step of forming the second surface layer can be 3 or more, light absorption on the first surface layer and the second surface layer can be reduced.

Thereby, light absorption on the whole surface layer can be reduced, and accordingly the effects of inhibiting the high-humidity flow and reducing the abrasion amount while keeping adequate sensitivity can be provided.

From the above description, in order to make the whole surface layer provide the effects of inhibiting the high-humidity flow and reducing the abrasion amount without causing other adverse effects, it is necessary to control $P^2$ so as to be larger than $P^1$ while supplying the source gas into the reaction vessel so that $C^2/S^2$ can be 3 or more and 25 or less. The electrophotographic photosensitive member can acquire more adequate effects of inhibiting the high-humidity flow and reducing the abrasion amount and more adequate sensitivity, when the source gas is supplied into the reaction vessel so that $C^2/S^2$ can be 4 or more and 15 or less. The hydrogen atoms in the surface layer are adjusted to a particularly suitable range by setting $1<P^2/P^1\leqq 3$, and the electrophotographic photosensitive member can acquire more adequate sensitivity.

It is also necessary to supply the source gas into the reaction vessel so that the ratio $C^1/S^1$ of a flow rate of $CH_4$ with respect to a flow rate of $SiH_4$ to be supplied in the step of forming the first surface layer can be $C^2/S^2$ or more and 60 or less.

Each of the surface layers can be stably formed by setting the hydrogen atoms to such a range, even when the second surface layer is continuously joined to the first surface layer. Thereby, the light absorption in a composite region is inhibited, so that adequate sensitivity can be maintained. Even when the second surface layer is discontinuously stacked on the first surface layer, a difference between the refractive indexes of the first surface layer and the second surface layer can be controlled to a predetermined range, and the reflection on the interface between the first surface layer and the second surface layer can be inhibited. As a result, even when the second surface layer is discontinuously stacked on the first surface layer, the adequate sensitivity can be maintained.

Furthermore, a difference of the stress originating from the structural difference between the first surface layer and the second surface layer is inhibited by controlling the amount of the source gas to be supplied in the step of forming the first surface layer to the above described conditions. As a result, the first surface layer and the second surface layer acquire adequate adhesiveness between them.

In order to provide effects of inhibiting a high-humidity flow and reducing an abrasion amount while thus avoiding a harmful effect from being caused when each surface layer is stacked, $C^1$ can be $C^2$ or more, and further $C^1/C^2$ can be 2 or more.

In addition, it is necessary to supply a source gas into a reaction vessel so that $C^2/S^2$ can be 3 or more and 25 or less and $C^1/S^1$ can be $C^2/S^2$ or more and 60 or less, and to adjust a high-frequency power so that $P^2>P^1$ can be satisfied, and so that both of C/(Si+C) relating to a first surface layer and C/(Si+C) relating to a second surface layer can be 0.50 or more and 0.80 or less.

It is considered that when both of C/(Si+C) relating to the first surface layer and C/(Si+C) relating to the second surface layer are larger than 0.80 by increasing the high-frequency power, bonds between carbon atoms originating in a graphite structure in an a-SiC surface layer increase. As a result, there is a case where light absorption increases and the sensitivity is aggravated.

In addition, when both of C/(Si+C) relating to the first surface layer and C/(Si+C) relating to the second surface layer are less than 0.50 by increasing the high-frequency power, the resistances of the first surface layer and the second surface layer themselves are lowered, and a carrier tends to easily cause a transverse flow in the surface layer when an electrostatic latent image is formed. Therefore, when isolated dots are formed for the electrostatic latent image, the isolated dots become small due to the transverse flow of the carrier in the surface layer. As a result, in the output image, the image concentration in a low concentration side decreases, which occasionally lowers the gradation properties.

Accordingly, an electrophotographic photosensitive member having superior effects of inhibiting a high-humidity flow and reducing an abrasion amount while keeping adequate characteristics of the electrophotographic photosensitive member is obtained by supplying the source gas into the reaction vessel so that $C^2/S^2$ is 3 or more and 25 or less and $C^1/S^1$ is $C^2/S^2$ or more and 60 or less, and by adjusting a high-frequency power so that $P^2>P^1$ is satisfied, and so that both of C/(Si+C) relating to the first surface layer and C/(Si+C) relating to the second surface layer can be 0.50 or more and 0.80 or less.

In the present invention, a pressure in a reaction vessel in a step of forming a second surface layer can be controlled to be equal to or higher than a pressure in a reaction vessel in a step of forming a first surface layer. This is because the resistance of a layer (deposited film) can be enhanced by increasing the pressure to be applied when a layer (deposited film) formed from a-SiC is formed. When the second surface layer is formed, the flow rate of $CH_4$ is small and the high-frequency power to be introduced is high, so that the resistance of the layer (deposited film) tends to be lowered. Adequate gradation properties can be stably obtained by increasing the pressure in the reaction vessel, even though the flow rate of $CH_4$ is small and the high-frequency power to be introduced is large.

The reason why the above described effect appears by increasing the pressure in the reaction vessel in this way is considered to be because the denseness of the surface layer is enhanced by phenomena that: 1) a staying time of a source gas supplied into the reaction vessel is extended; and 2) a drawing reaction of hydrogen atoms occurs in the surface layer due to hydrogen atoms and hydrogen radicals produced by the decomposition of the source gas. It is also assumed that such an effect remarkably appears because the high-frequency power is set in the step of forming the second surface layer so as to be larger than that in the step of forming the first surface layer.

In the present invention, a film thickness of a second surface layer can be 0.20 μm or more and 1.00 μm or less. The total film thickness of a first surface layer and the second surface layer (sum of film thicknesses of first surface layer and second surface layer) can be 0.30 μm or more and 1.50 μm or less.

Even though the second surface layer is thin, an electrophotographic photosensitive member does not particularly cause problems in its high-humidity flow, gradation properties and sensitivity, in an early period of use. However, when the electrophotographic photosensitive member has been used for a long period of time in an electrophotographic apparatus, the second surface layer is abraded by a cleaning member or the like. The second surface layer can have a film thickness of 0.20 μm or more in order to keep an effect of inhibiting the high-humidity flow for a practically acceptable period, even in the above case. On the other hand, when the film thickness of the second surface layer increases, the influence of the light absorption in the second surface layer occasionally affects the sensitivity, so that the film thickness of the second surface layer can be 1.00 μm or less.

In a case where the total film thickness of the first surface layer and the second surface layer is thin as well, the electrophotographic photosensitive member does not cause problems in the high-humidity flow, gradation properties and sensitivity, as long as the electrophotographic photosensitive member is used in a normal environment. However, when a foreign matter is trapped in between a cleaning member and the electrophotographic photosensitive member in the electrophotographic apparatus, an image failure may occasionally occur due to the compression of the foreign matter. On the other hand, as the total film thickness of the first surface layer and the second surface layer increases, the light absorption increases, so that the excessively thickened film occasionally affects the sensitivity characteristics.

From this reason, the total film thickness of the first surface layer and the second surface layer can be 0.30 μm or more and 1.50 μm or less. When considering the image failure due to the trapped foreign matter to be caused when the electrophotographic photosensitive member in the electrophotographic apparatus has been used for a long period of time, the total film thickness thereof can further be 0.50 μm or more and 1.50 μm or less.

Figure 4A:
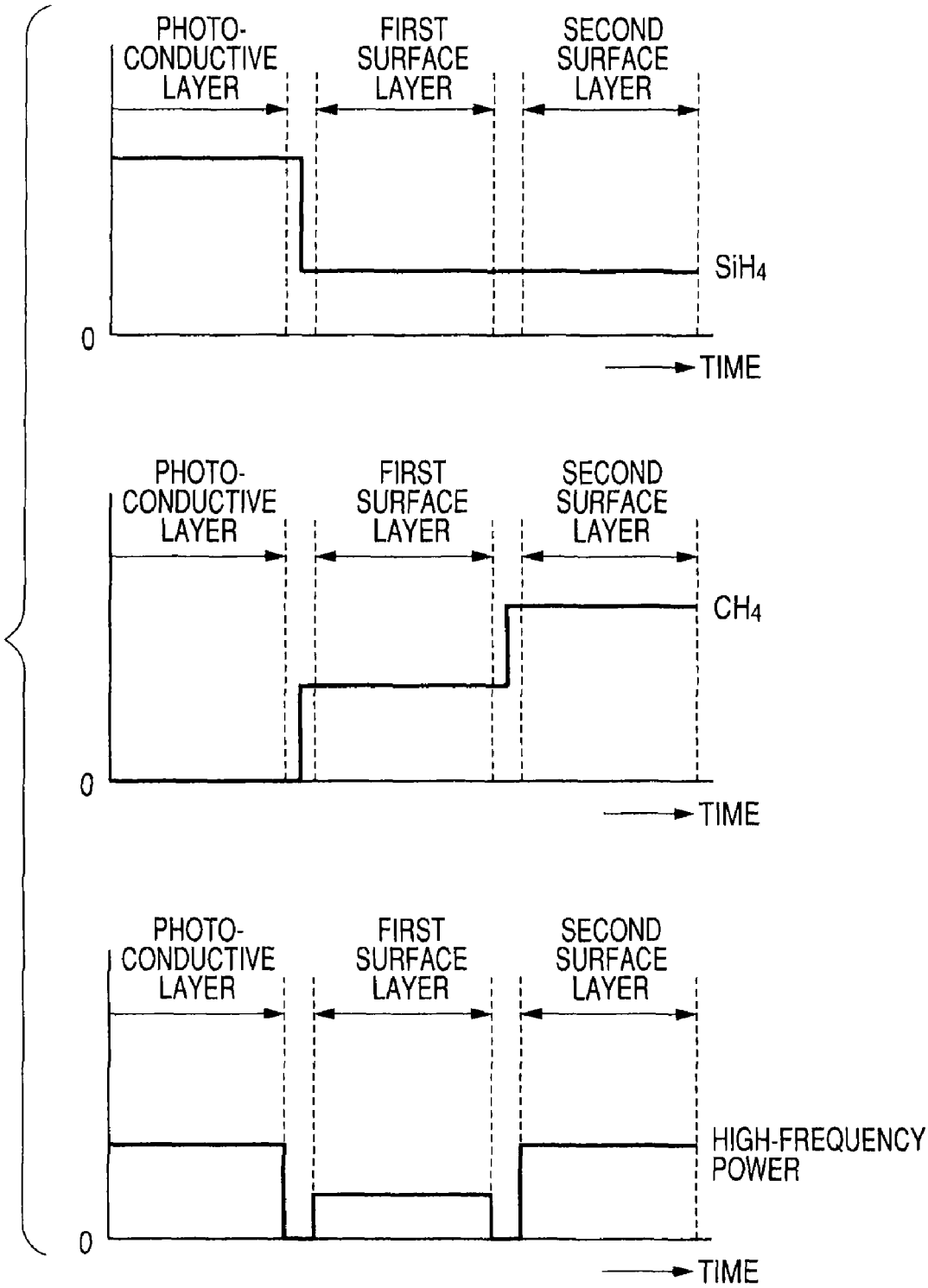
FIGS. 4A, 4B and 4C are views illustrating one example of the timing at which a high-frequency power and $SiH_4$ and $CH_4$ to be source gases are supplied when a photoconductive layer, a first surface layer and a second surface layer are formed in this order according to the manufacturing method of the present invention.
Figure 4B:
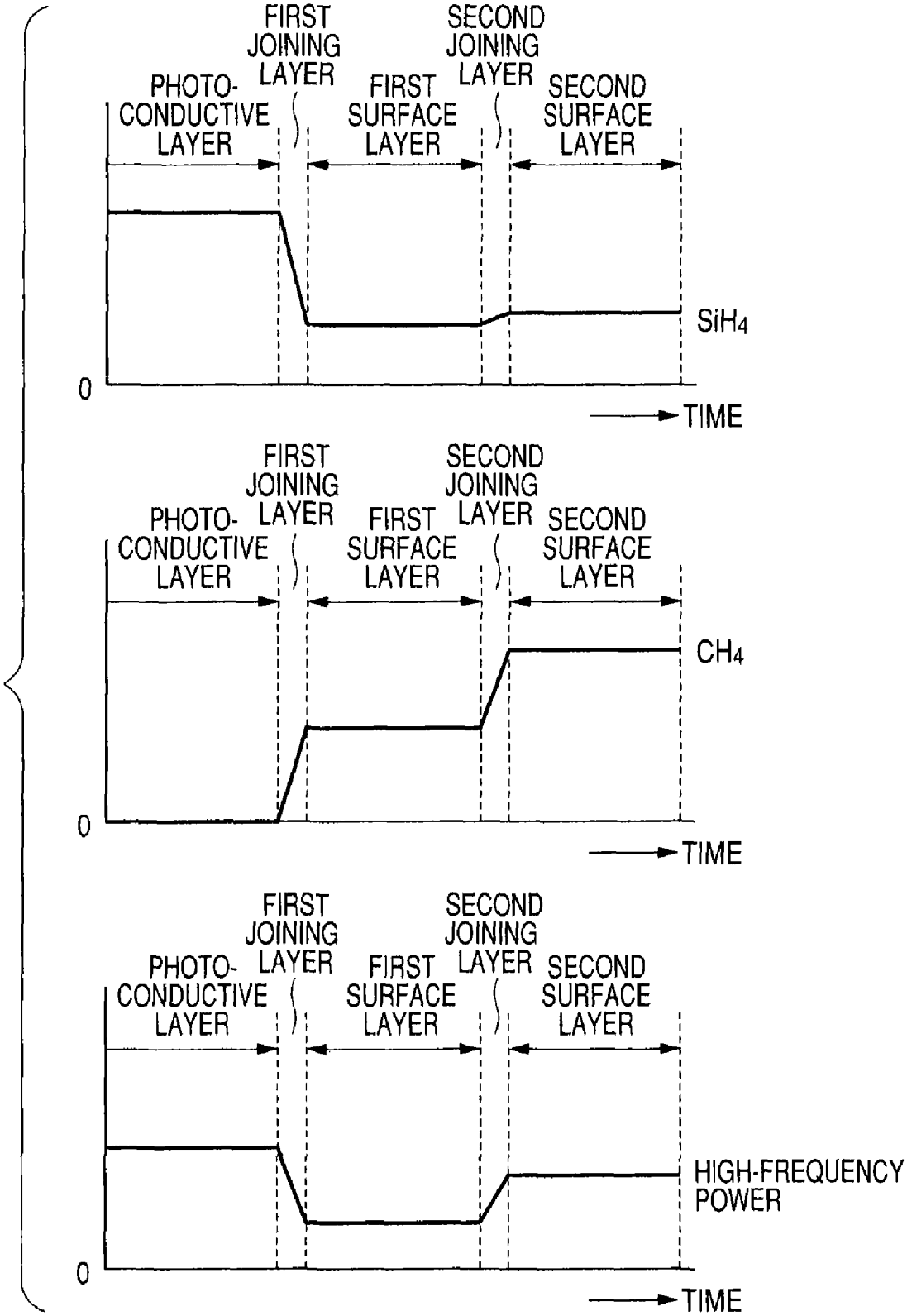
Figure 4C:
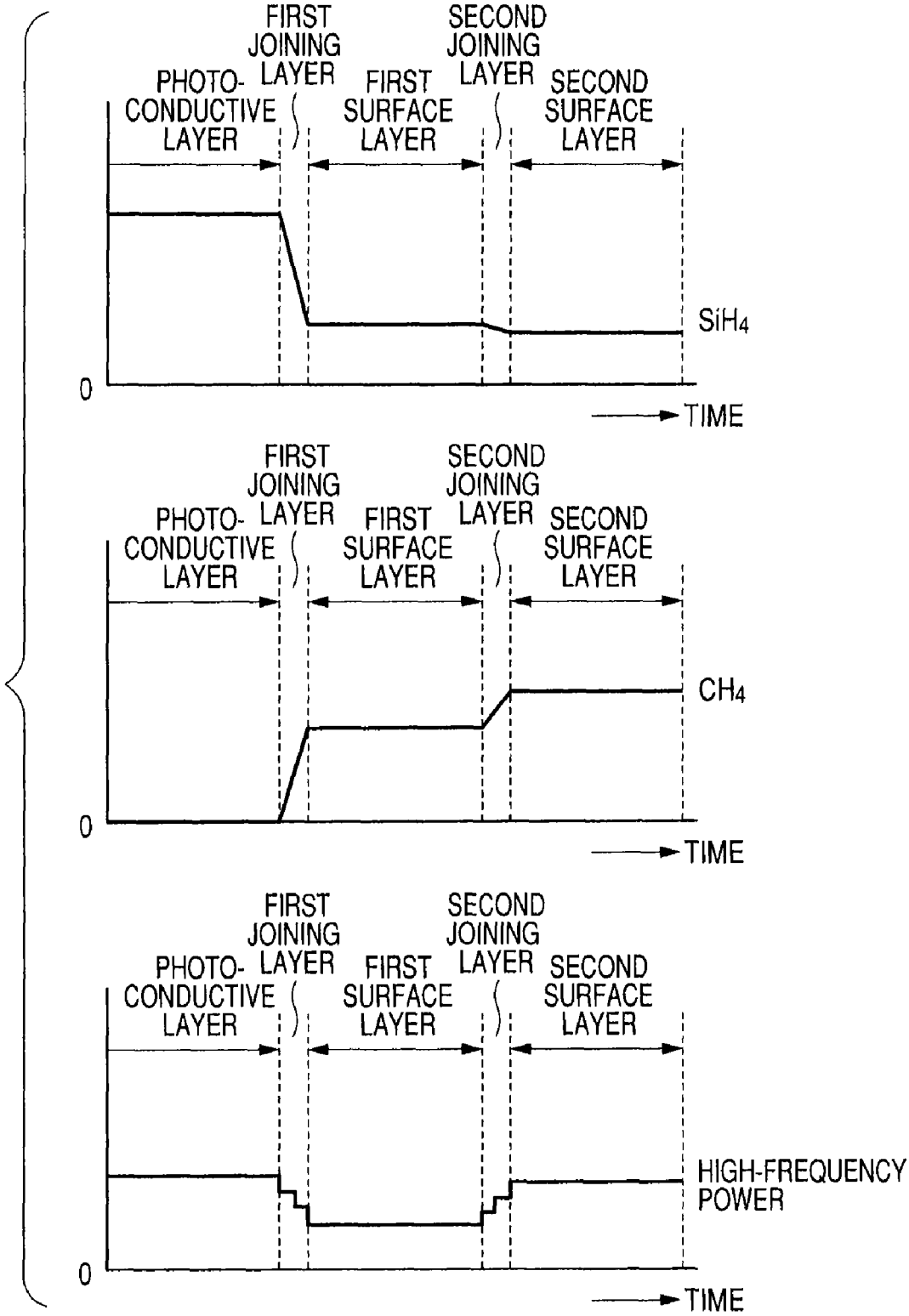
Figure 5A:
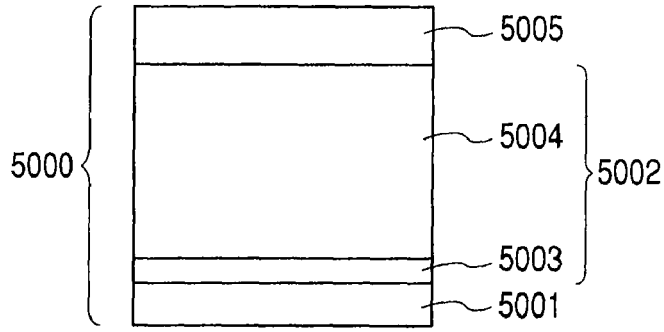
FIGS. 5A and 5B are views illustrating a basic structure of a conventional electrophotographic photosensitive member (a-Si photosensitive member).
Figure 5B:
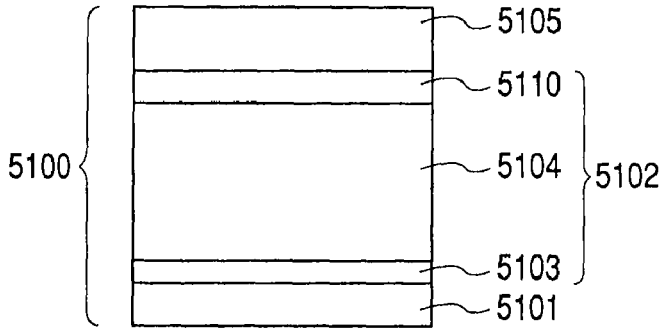

FIGS. 4A, 4B and 4C are views illustrating one example of the timings at which a high-frequency power and $SiH_4$ and $CH_4$ to be source gases are supplied when a photoconductive layer, a first surface layer and a second surface layer are formed in this order according to a manufacturing method of the present invention.

The horizontal axis of FIGS. 4A to 4C represents an elapsed time, and the vertical axis thereof represents an amount of a source gas to be supplied or an amount of a high-frequency power to be supplied.

In FIG. 4A, after the photoconductive layer is formed by supplying $SiH_4$ and a high-frequency power, the supply of the high-frequency power is stopped, then the supply of $SiH_4$ is reduced, and $CH_4$ is introduced. Then, after the amount of $SiH_4$ and $CH_4$ to be supplied has become stable, the high-frequency power is supplied, and the first surface layer is formed. Afterwards, the supply of the high-frequency power is stopped. After the supply of the high-frequency power has been stopped, the supply of $CH_4$ is reduced, then the high-frequency power is supplied, and the second surface layer is formed.

In FIG. 4A, the high-frequency power is supplied only in such a state that an amount to be supplied of $SiH_4$ and $CH_4$ which form the photoconductive layer, the first surface layer and the second surface layer is stable.

In FIG. 4B, $SiH_4$ and the high-frequency power are supplied to form the photoconductive layer. Subsequently, the supply of the high-frequency power and $SiH_4$ is gradually reduced at a constant rate, and the supply of $CH_4$ is gradually increased in the period. When the supply of $SiH_4$, $CH_4$ and the high-frequency power has reached a desired amount, the amount to be supplied is kept constant, and the first surface layer is formed. When the first surface layer has been formed so as to have a desired film thickness, the supply of $SiH_4$ and the high-frequency power is increased at a constant rate. When the supply of $SiH_4$ and the high-frequency power has reached a desired amount, the amount to be supplied is kept constant, and the second surface layer is formed.

In FIG. 4C, $SiH_4$ and high-frequency power are supplied to form the photoconductive layer. Subsequently, the supply of the high-frequency power and $SiH_4$ is gradually reduced at a constant rate, and the supply of $CH_4$ is gradually increased in the period. When the supply of $SiH_4$, $CH_4$ and the high-frequency power has reached a desired amount, the amount to be supplied is kept constant, and the first surface layer is formed. When the first surface layer has been formed so as to have a desired film thickness, $SiH_4$ is increased at a constant rate, on the contrary, $CH_4$ is decreased at a constant rate, and the supply of the high-frequency power is increased step by step. When the supply of $SiH_4$, $CH_4$ and the high-frequency power has reached a desired amount, the amount to be supplied is kept constant and the second surface layer is formed.

In FIG. 4A, before the formation of a first surface layer is started after the formation of a photoconductive layer is completed and before the formation of a second surface layer is started after the formation of a first layer is completed, a high-frequency power is not supplied until an amount to be supplied of a source gas reaches a desired amount to be supplied, so that the layers are not formed. In contrast to this, in FIGS. 4B and 4C, the supply of the source gas is changed without interruption of the supply of the high-frequency power, so that a first joining region is formed between the photoconductive layer and the first surface layer, and a second joining region is formed between the first surface layer and the second surface layer.

The electrophotographic photosensitive members which have been formed in the procedure in FIG. 4A show structures of FIG. 1A and FIG. 2. In contrast to this, the electrophotographic photosensitive members which have been formed in the procedure in FIGS. 4B and 4C show a structure, for instance, as illustrated in FIG. 1C. A positively chargeable a-Si photosensitive member 1200 in FIG. 1C has a light receiving layer 1202 and a surface layer 1205 provided in this order on a conductive substrate 1201. The light receiving layer 1202 has a lower electric-charge injection preventing layer 1203, which is made from silicon atoms of a base material (lower electric-charge injection preventing layer formed from amorphous material containing silicon atom), and a photoconductive layer 1204 which is made from silicon atoms of a base material (photoconductive layer formed from amorphous material containing silicon atom), provided in this order. The surface layer 1205 has a first joining region 1208 which is made from silicon atoms and carbon atoms of a base material (first joining region formed from amorphous material containing silicon atom and carbon atom), a first surface layer 1206 which is made from silicon atoms and carbon atoms of a base material (first surface layer formed from amorphous material containing silicon atom and carbon atom), a second joining region 1209 which is made from silicon atoms and carbon atoms of a base material (second joining region formed from amorphous material containing silicon atom and carbon atom), and a second surface layer 1207 which is made from silicon atoms and carbon atoms of a base material (second surface layer formed from amorphous material containing silicon atom and carbon atom), provided in this order.

In the case of such a layer structure, in the present invention, the region of a first surface layer is defined as a first joining region 1208, a first surface layer 1206 and a second joining region 1209, and the region of a second surface layer is defined as the second surface layer 1207. In the region of the first surface layer, $C^1$, $S^1$, $P^1$ and C/(Si+C) are respectively defined as the flow rate of $CH_4$, the flow rate of $SiH_4$, the high-frequency power and the ratio of a number of atom of carbon atoms with respect to the sum of number of atoms of silicon atoms and carbon atoms, at the time when the first surface layer 1206 is formed.

When the first joining region 1208 and the second joining region 1209 are formed, the amounts of $SiH_4$ and $CH_4$ to be supplied into a reaction vessel can be continuously increased or decreased without being suddenly changed, as is illustrated in FIGS. 4B and 4C. Regarding introduction of the high-frequency power, the high-frequency power can be continuously changed as is illustrated in FIG. 4B or can be changed step by step in a short period of time as is illustrated in FIG. 4C.

Furthermore, the pressures at the first joining region and the second joining region can also be controlled so as to continuously increase or decrease.

In addition, in the case where a deposited film has been continuously formed, the film thickness of the first surface layer is defined as the total film thickness of the first joining region 1208, the first surface layer 1206 and the second joining region 1209. The ratio of the film thicknesses of the first joining region 1208, the first surface layer 1206 and the second joining region 1209 at this time is not limited in particular, but the film thickness of the first surface layer 1206 can be controlled so as to be thicker than that of the first joining region 1208 and the second joining region 1209, in order to control characteristics of the electrophotographic photosensitive member.

Figure 3:
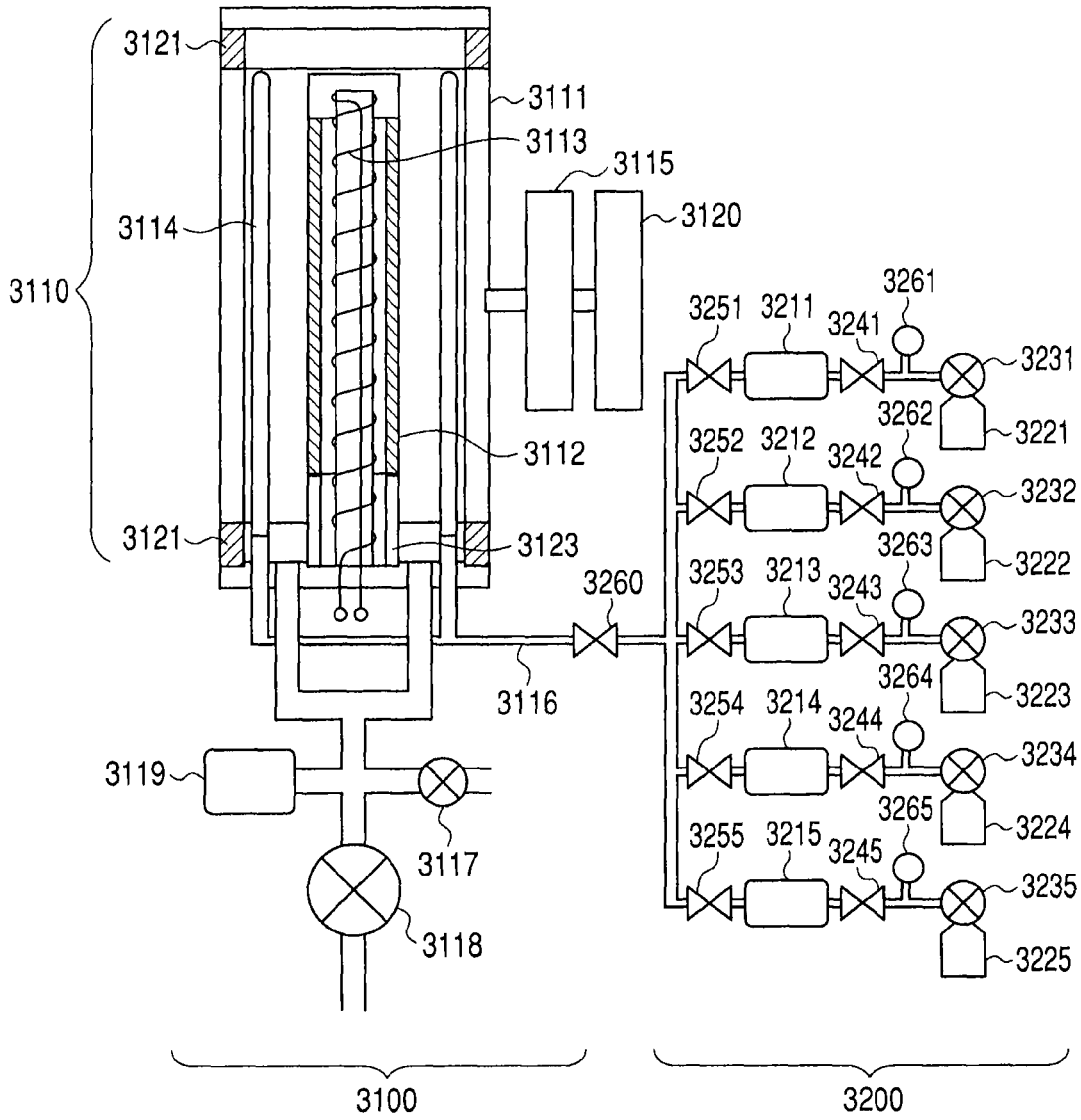
FIG. 3 is a view schematically illustrating one example of an apparatus for forming deposited film for an electrophotographic photosensitive member, which employs an RF plasma CVD method with the use of a high-frequency power source for preparing an a-Si photosensitive member of the present invention.

FIG. 3 is a view schematically illustrating one example of an apparatus for forming deposited film for an electrophotographic photosensitive member, which employs an RF plasma CVD method with the use of a high-frequency power source for preparing an a-Si photosensitive member of the present invention.

This apparatus is mainly constituted by a deposition device 3100 having a reaction vessel 3110 therein, a source gas supply device 3200 and an exhaust device (not shown) for decompressing the inside of the reaction vessel 3110.

The reaction vessel 3110 which can be evacuated in the deposition device 3100 has a conductive substrate 3112 connected to a ground, a heater 3113 for heating a substrate and a gas introduction pipe 3114, arranged therein. A high-frequency power source 3120 is connected to a cathode 3111 through a high-frequency matching box 3115.

The source gas supply device 3200 is constituted by bombs of source gases 3221 to 3225 for $SiH_4$, $H_2$, $CH_4$, NO, $B_2H_6$ and $CF_4$, valves 3231 to 3235, pressure controllers 3261 to 3265, inflow valves 3241 to 3245, outflow valves 3251 to 3255 and mass flow controllers 3211 to 3215. Bombs having the respective source gases sealed therein are connected to a source gas introduction pipe 3114 in the reaction vessel 3110 through an auxiliary valve 3260.

Subsequently, a method for forming a deposited film with the use of this apparatus will now be described below.

Firstly, a reaction vessel 3110 is fixed, and a conductive substrate 3112 which has been previously degreased and cleaned is mounted on a cradle 3123 in the reaction vessel 3110. Subsequently, an exhaust device (not shown) is operated, and the inside of the reaction vessel 3110 is exhausted. When the pressure in the reaction vessel 3110 has reached a predetermined pressure, for instance, of 1 Pa or lower, an operator shall supply an electric power to a heater 3113 for heating the substrate to heat the conductive substrate 3112 to a desired temperature, for instance, of 50 to 350° C., while watching a display of a vacuum gage 3119. At this time, by supplying an inert gas such as Ar and He from a gas supply device 3200 to the reaction vessel 3110, the conductive substrate 3112 can be heated in the inert gas atmosphere.

Subsequently, a gas to be used for forming the deposited film is supplied from the gas supply device 3200 to the reaction vessel 3110. Specifically, the valves 3231 to 3235, the inflow valves 3241 to 3245 and the outflow valves 3251 to 3255 are opened as needed, and the flow rates of the mass flow controllers 3211 to 3215 are set. When the flow rate of each of the mass flow controllers 3211 to 3215 becomes stable, an operator shall operate a main valve 3118 to adjust the pressure in the reaction vessel 3110 to a desired pressure, while watching the display of the vacuum gage 3119. When the desired pressure is obtained, an operator shall apply the high-frequency power to the reaction vessel 3110 from a high-frequency power source 3120, and simultaneously operates the high-frequency matching box 3115 to generate plasma discharge in the reaction vessel 3110. Then, the high-frequency power is immediately controlled to a desired electric power to form the deposited film.

When the formation of predetermined deposited film has been finished, the application of the high-frequency power is stopped, the valves 3231 to 3235, the inflow valves 3241 to 3245, the outflow valves 3251 to 3255 and the auxiliary valve 3260 are closed, the supply of the source gas is finished, and simultaneously the main valve 3118 is opened to exhaust the inside of the reaction vessel 3110 to the pressure of 1 Pa or lower.

By the above described steps, the formation of the deposited layer is finished, but when a plurality of deposited layers are formed, the respective layers may be formed by repeating the above described steps again. The joining regions can be also formed by changing a flow rate of a source gas and a pressure in the reaction vessel to conditions for forming the photoconductive layer in a fixed period of time.

After the formation of all deposited films has been finished, the main valve 3118 is closed, an inert gas is introduced into the reaction vessel 3110 to return the pressure to atmospheric pressure, and the conductive substrate 3112 is taken out.

For information, a gas pipe 3116, a leak valve 3117 and an insulation material 3121 are shown.

The present invention will now be described further in detail below with reference to examples and comparative examples, but is not limited by those.

EXAMPLE 1

A positively chargeable a-Si photosensitive member was prepared by forming each layer on a conductive substrate (cylindrical substrate made from aluminum, which has diameter of 80 mm, length of 358 mm and thickness of 3 mm, and has been mirror-finished) by using a plasma treatment apparatus with the use of a high-frequency power source with an RF range as illustrated in FIG. 3, on conditions shown in the following Table 1 and Table 2. At this time, films of an electric-charge injection preventing layer, a photoconductive layer, a first surface layer and a second surface layer were formed (layer formation), in this order, and a film-forming period of time was controlled so that the film thicknesses of the layers could be respective values in Table 1. In addition, two electrophotographic photosensitive members were prepared for each film-forming condition.

TABLE 1

| | electric-charge injection preventing layer | photo-conductive layer | first surface layer | second surface layer |
|---|---|---|---|---|
| gas type and flow rate | | | | |
| $SiH_4$ [mL/min (normal)] | 350 | 450 | 25 | 25 |
| $H_2$ [mL/min (normal)] | 750 | 2200 | | |
| $B_2H_6$ [ppm ] (w.r.t. $SiH_4$) | 1500 | 1 | | |
| NO [mL/min (normal)] | 10 | | | |
| $CH_4$ [mL/min (normal)] | | | 1400 | Table 2 |
| inner pressure [Pa] | 40 | 80 | 50 | 55 |
| high-frequency power [W] | 400 | 800 | 400 | Table 2 |
| substrate temperature [° C.] | 260 | 260 | 260 | 260 |
| film thickness [μm] | 3 | 25 | 0.4 | 0.3 |

TABLE 2

| | film-forming condition No. | | | |
|---|---|---|---|---|
| | 1 | 2 | 3 | 4 |
| $CH_4$ [mL/min (normal)]: $C^2$ | 625 | 375 | 100 | 75 |
| high-frequency power [W]: $P^2$ | 900 | 600 | 600 | 600 |

A ratio (C/(Si+C)) of a number of atoms of carbon atoms with respect to the sum of number of atoms of silicon atoms and carbon atoms was obtained through an analysis method which will be described later, with the use of one electrophotographic photosensitive member for each film-forming condition out of two electrophotographic photosensitive members prepared for each film-forming condition, which had been prepared in Example 1. The other electrophotographic photosensitive member for each film-forming condition was used for the evaluation of a high-humidity flow, durability, gradation properties and sensitivity carried out in an evaluation condition which will be described later. The results are shown in Table 5.

COMPARATIVE EXAMPLE 1

Each of two positively chargeable a-Si photosensitive members was prepared by forming each layer on the same conductive substrate as the above described one, by using a plasma treatment apparatus with the use of a high-frequency power source with an RF range as illustrated in FIG. 3, in conditions shown in the following Table 3. At this time, films of an electric-charge injection preventing layer, a photoconductive layer and a surface layer were formed (layer formation), in this order, and a film-forming period of time was controlled so as to give the respective layers the film thicknesses in Table 3.

TABLE 3

| | electric-charge injection preventing layer | photoconductive layer | surface layer |
|---|---|---|---|
| gas type and flow rate | | | |
| $SiH_4$ [mL/min (normal)] | 350 | 450 | 25 |
| $H_2$ [mL/min (normal)] | 750 | 2200 | |
| $B_2H_6$ [ppm] (w.r.t.$SiH_4$) | 1500 | 1 | |
| NO [mL/min (normal)] | 10 | | |
| $CH_4$ [mL/min (normal)] | | | 1400 |
| inner pressure [Pa] | 40 | 80 | 50 |
| high-frequency power [W] | 400 | 800 | 400 |
| substrate temperature [° C.] | 260 | 260 | 260 |
| film thickness [μm] | 3 | 25 | 0.3 |

The ratio C/(Si+C) of the electrophotographic photosensitive member which had been prepared in Comparative example 1 was determined, and the high-humidity flow, durability, gradation properties and sensitivity thereof were evaluated, similarly to those in Example 1. The results are shown in Table 5. The film-forming condition of the electrophotographic photosensitive member which had been prepared in Comparative example 1 was determined to be No. 5.

In the electrophotographic photosensitive member of the film-forming condition No. 5, which had been prepared in Comparative example 1, the flow rates of $CH_4$ and $SiH_4$ to be supplied into the reaction vessel when the surface layer was deposited were defined as $C^3$ and $S^3$, and the high-frequency power to be introduced into the reaction vessel was defined as $P^3$.

COMPARATIVE EXAMPLE 2

Each of two positively chargeable a-Si photosensitive members was prepared by forming each layer on the same conductive substrate as the above described one, by using a plasma treatment apparatus with the use of a high-frequency power source with an RF range as illustrated in FIG. 3, in conditions shown in the above described Table 1, similarly to Example 1. However, the flow rate of $CH_4$ and the high-frequency power of a second surface layer were set at conditions shown in Table 4.

TABLE 4

| | film-forming condition No. | | | | |
|---|---|---|---|---|---|
| | 6 | 7 | 8 | 9 | 10 |
| $CH_4$ [mL/min (normal)]: $C^2$ | 1400 | 625 | 625 | 75 | 50 |
| high-frequency power [W]: $P^2$ | 600 | 400 | 1000 | 450 | 800 |

The ratio C/(Si+C) of the electrophotographic photosensitive member which had been prepared in Comparative example 2 was determined, and the high-humidity flow, durability, gradation properties and sensitivity thereof were evaluated, similarly to those in Example 1. The results are shown in Table 5.

(Measurement of C/(Si+C))

As for the measurement of C/(Si+C), the C/(Si+C) was calculated by measuring a sample which had been cut out into 10 mm by 10 mm was subjected to the measurement by an X-ray photoelectron spectroscopic instrument on a central portion of the longitudinal direction of the electrophotographic photosensitive member and at an arbitrary portion in the peripheral direction thereof. The used X-ray photoelectron spectroscopy apparatus was QUANTUM2000 SCANNING ESCA MICROPROBE which is a product made by ULVAC-PHI, Inc.

Specifically, depth profiles of a silicon atom (Si), a carbon atom (C) and an oxygen atom (O) were measured between the surface and the photoconductive layer in the electrophotographic photosensitive member. The ratio of Si and C in a first surface layer and a second surface layer was calculated based on the obtained result, the average values in each layer were calculated, and the values were determined to be the C/(Si+C). However, as for the calculation of C/(Si+C) of the second surface layer, in order to remove an effect of a deposit or the like existing in the top surface side of the electrophotographic photosensitive member, C/(Si+C) was calculated without using a data in between the position at which O was not detected any more and the top surface side of the electrophotographic photosensitive member.

The orbits of the analyzed Si, C and O were Si2p, C1s and O1s. The employed measurement conditions were the spot diameter of 100 μm, the X-ray intensity of 25 W at 15 kV, the pass energy of 23.5 eV, the step size of 0.1 eV and the sweep number of 10. The region in 2 mm by 2 mm was sputtered on conditions of employing an Ar ion, an accelerating voltage of 4 kV and a sputtering period of one minute. The depth profiles of Si, C and O were formed by alternately repeating a sputtering operation and a measurement operation.

(Evaluation of High-humidity Flow)

Figure 6:
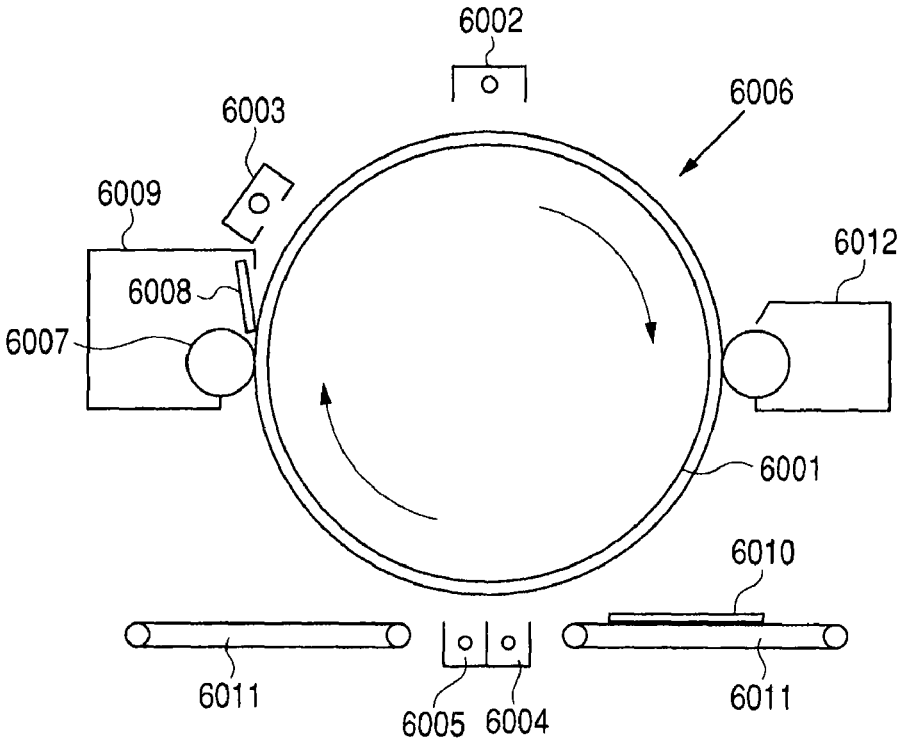
FIG. 6 is a schematic sectional view illustrating a structure of an electrophotographic apparatus used in examples.

The electrophotographic apparatus to be used in the evaluation of a high-humidity flow was an electrophotographic apparatus having a structure as is illustrated in FIG. 6. An electrophotographic photosensitive member 6001, a main charging device 6002, a discharging device 6003, a transfer charging device 6004, a separation charging device 6005, an electrostatic latent image unit 6006, a magnet roller 6007, a cleaning blade 6008, a cleaner 6009, a transfer material 6010, a transporting unit 6011 and a developing device 6012 are shown. A specifically employed electrophotographic apparatus was iR-5065 which is a product made by Canon Inc.

The prepared electrophotographic photosensitive member was arranged in the above described electrophotographic apparatus, and an A3 letter chart (4 pt and printing rate of 4%) was output in the environment of a temperature of 25° C. and a relative humidity of 75% (volume absolute humidity of 17.3 g/cm$^3$), prior to a continuous paper-feeding test.

After the image had been output prior to the continuous paper-feeding test, the continuous paper-feeding test was carried out. The continuous paper-feeding test was carried out on conditions that a heater for heating the photosensitive member was turned ON while the electrophotographic apparatus was operated and the continuous paper-feeding test was carried out, and that the heater for heating the photosensitive member was turned OFF while the electrophotographic apparatus was stopped.

Specifically, the continuous paper-feeding test of 25,000 sheets of paper per day was carried out for ten days up to 250,000 sheets with the use of the A4 test chart of the printing rate of 1%. After the continuous paper-feeding test, the electrophotographic apparatus were left for 15 hours in the environment of a temperature of 25° C. and a relative humidity of 75% (volume absolute humidity of 17.3 g/cm$^3$).

After 15 hours, the heater for heating the photosensitive member was turned ON, the electrophotographic apparatus was set up, and the A3 letter chart (4 pt and printing rate of 4%) was output. The images which had been output before the continuous paper-feeding test and output after the continuous paper-feeding test were converted into an electronic form of a PDF file on the condition of two values of a monochromatic 300 dpi, with the use of iRC-5870 which is a digital electrophotographic apparatus made by Canon Inc. The black ratio in a region (251.3 mm×273 mm) of the image converted into the electronic form corresponding to one rotation of the electrophotographic photosensitive member was measured with the use of an image editing software "Adobe Photoshop" made by Adobe Systems Incorporated. Subsequently, the ratio of the black ratio of the image which had been output after the continuous paper-feeding test with respect to that of the image which had been output before the continuous paper-feeding durability test was obtained, and the high-humidity flow was evaluated.

When the high-humidity flow has occurred, the letters are blurred or form a blank area without being printed in the whole image, so that the black ratio in the output image decreases compared to a normal image output before the continuous paper-feeding test. Accordingly, the closer to 100% is the ratio of the black ratio of the image which has been output after the continuous paper-feeding test with respect to that of a normal image output before the continuous paper-feeding test, the more adequate becomes the high-humidity flow. When the high-humidity flow was evaluated to be class (B) or higher, the effect of the present invention was determined to have been obtained.

Class (A) means that the black rate of the image which has been output after the continuous paper-feeding test with respect to the image output before the continuous paper-feeding test is 90% or more and 105% or less.

Class (B) means that the black rate of the image which has been output after the continuous paper-feeding test with respect to the image output before the continuous paper-feeding test is 80% or more and less than 90%.

Class (C) means that the black rate of the image which has been output after the continuous paper-feeding test with respect to the image output before the continuous paper-feeding test is less than 80%.

(Evaluation of Durability)

Durability was evaluated by a method of measuring the film thickness of a surface layer of an electrophotographic photosensitive member right after having been prepared, at the total 18 points of 9 points in a longitudinal direction (0 mm, ±50 mm, ±90 mm, ±130 mm and ±150 mm with respect to the center in the longitudinal direction of the electrophotographic photosensitive member) in an arbitrary point in a peripheral direction of the electrophotographic photosensitive member and 9 points in a longitudinal direction of the position at which the peripheral direction is rotated by 180 degrees, and calculating the total film thickness of a first surface layer and a second surface layer based on the average value of 18 points.

The film thickness was measured by vertically irradiating the surface of the electrophotographic photosensitive member with a light having a spot diameter of approximately 2 mm, and measuring a spectral of a reflected light with the use of a spectrometer (MCPD-2000: product made by OTSUKA ELECTORONICS CO., LTD.). The film thickness of the surface layer was calculated based on the obtained reflection waveform. At this time, the index of refraction of the photoconductive layer was assumed to be 3.30, and the index of refraction of the surface layer was assumed to be 2.00.

After the film thickness had been measured, the electrophotographic photosensitive member was arranged in iR-5065 which is a digital electrophotographic apparatus made by Canon Inc., and a continuous paper-feeding test was carried out in the environment of the temperature of 25° C. and the relative humidity of 75%, in the similar condition to the evaluation for the high-humidity flow. After the continuous paper-feeding test of 250,000 sheets had been finished, the electrophotographic photosensitive member was taken out from the electrophotographic apparatus, the film thickness was measured at the same positions as those right after the preparation, and the average value of the total film thickness of the first surface layer and the second surface layer after the continuous paper-feeding test was calculated. Then, a difference was determined from the average film thicknesses of the whole surface layer which had been obtained right after the preparation and after the continuous paper-feeding test, and an abrasion amount due to the continuous paper-feeding test of the 250,000 sheets was calculated. The durability was evaluated by calculating the abrasion amount after the continuous paper-feeding test of 6,000,000 sheets (24 times) based on the abrasion amount due to the continuous paper-feeding test of 250,000 sheets, and calculating the ratio of the calculated abrasion amount after the continuous paper-feeding test of 6,000,000 sheets with respect to an initial film thickness of the second surface layer. When the durability was evaluated to be class (B) or higher, the effect of the present invention was determined to be obtained.

Class (A) means that the ratio of the abrasion amount after the continuous paper-feeding test of 6,000,000 sheets with respect to the initial film thickness of the second surface layer is 100% or less.

Class (B) means that the ratio of the abrasion amount after the continuous paper-feeding test of 6,000,000 sheets with respect to the initial film thickness of the second surface layer is more than 100% and 150% or less.

Class (C) means that the ratio of the abrasion amount after the continuous paper-feeding test of 6,000,000 sheets with respect to the initial film thickness of the second surface layer is more than 150%.

(Evaluation of Gradation Properties)

The gradation properties were evaluated with the use of a remodeled machine of iR-5065 which is a digital electrophotographic apparatus made by Canon Inc. At first, a gradation data was prepared in which the whole gradation range was equally divided into 17 steps according to an area gradation with the use of an area gradation dot screen having a line density of 141 lpi (141 lines per one inch) at 45 degrees by a light for image exposure (in other words, area gradation of dot portions to be used for exposing image). At this time, the gradation steps were formed by deciding the darkest gradation to be 17, deciding the lightest gradation to be 0, and assigning numbers to each gradation.

Next, the electrophotographic photosensitive member was arranged in the above described remodeled electrophotographic apparatus, and an image was output on an A3 paper in a text mode by using the above described gradation data. At this time, if the high-humidity flow occurred, the evaluation for an image blur would be affected. Accordingly, the image was output in the environment of the temperature of 22° C. and the relative humidity of 50%, and on the condition of keeping the surface of the electrophotographic photosensitive member at approximately 40° C. by turning the heater for heating the photosensitive member ON.

The image density of the obtained image was measured in each gradation with the use of a reflection densitometry (504 spectral densitometry: product made by X-Rite Incorporated). Three sheets of the images were output for every gradation to have the reflection density measured, and the average value of the concentrations was determined to be the evaluation value.

The gradation properties were evaluated by calculating a correlation coefficient between thus obtained evaluation value and the gradation step, and using a ratio of the correlation coefficient of the electrophotographic photosensitive member which had been prepared on each film-forming condition with respect to the correlation coefficient of the electrophotographic photosensitive member which had been prepared in the film-forming condition No. 2, as an indication of the gradation properties. In this evaluation method, the larger is the numeric value, the more excellent are the gradation properties. In the evaluation, when the gradation properties were evaluated as class (A), the effect of the present invention was determined to be obtained.

Class (A) means that the ratio of the correlation coefficient calculated on the electrophotographic photosensitive member which had been prepared in each film-forming condition with respect to the correlation coefficient calculated on the electrophotographic photosensitive member which had been prepared in the film-forming condition No. 2 is 0.80 or more.

Class (B) means that the ratio of the correlation coefficient calculated on the electrophotographic photosensitive member which had been prepared in each film-forming condition with respect to the correlation coefficient calculated on the electrophotographic photosensitive member which had been prepared in the film-forming condition No. 2 is less than 0.80.

(Evaluation of Sensitivity)

The sensitivity was evaluated with the use of a remodeled machine of iR-5065 which is a digital electrophotographic apparatus made by Canon Inc. The high voltage power source was connected to a wire and a grid of a charging device respectively in a state of having turned the image exposure off, the grid potential was set at 820 V, and the surface potential of the electrophotographic photosensitive member was set at 400 V while adjusting an electric current to be supplied to the wire of the charging device.

Next, the potential at the position of the developing device was set at 100 V by irradiating the image with an exposing light and adjusting its irradiation energy, and the irradiation energy quantity was determined to be the evaluation value for the sensitivity. The evaluation result was shown by a result of a relative comparison in which the sensitivity in the case of having mounted the electrophotographic photosensitive member of the film-forming condition No. 2 which had been prepared in Example 1 is considered as 1.00.

The light source of the image exposure of the electrophotographic apparatus which was used for the evaluation of the sensitivity was a semiconductor laser having the oscillation wavelength of 658 nm. In the evaluation, when the sensitivity was evaluated to be class (C) or higher, the effect of the present invention was determined to be obtained.

Class (A) means that a ratio of irradiation energy quantity with respect to the irradiation energy quantity of the electrophotographic photosensitive member of the film-forming condition No. 2, which had been prepared in Example 1, is less than 1.10.

Class (B) means that the ratio of the irradiation energy quantity with respect to the irradiation energy quantity of the electrophotographic photosensitive member of the film-forming condition No. 2, which had been prepared in Example 1, is 1.10 or more and less than 1.15.

Class (C) means that the ratio of the irradiation energy quantity with respect to the irradiation energy quantity of the electrophotographic photosensitive member of the film-forming condition No. 2, which had been prepared in Example 1, is 1.15 or more and less than 1.20.

Class (D) means that the ratio of the irradiation energy quantity with respect to the irradiation energy quantity of the electrophotographic photosensitive member of the film-forming condition No. 2, which had been prepared in Example 1, is 1.20 or more.

The results relating to C/(Si+C), high-humidity flow, durability, gradation properties and sensitivity of Example 1, Comparative example 1 and Comparative example 2 are shown in Table 5.

As is clear from the results in Table 5, the electrophotographic photosensitive member superior in high-humidity flow, abrasion amount, sensitivity and gradation properties was obtained by adjusting the film-forming conditions of the first surface layer and the second surface layer so that $3 \leqq C^2/S^2 \leqq 25$ and $P^2 > P^1$ could be satisfied and C/(Si+C) relating to the second surface layer could be $0.50 \leqq C/(Si+C) \leqq 0.80$. Furthermore, the electrophotographic photosensitive member having a particularly adequate high-humidity flow and sensitivity was obtained by controlling the film-forming condition of the second surface layer to a range expressed by $4 \leqq C^2/S^2 \leqq 15$.

In addition, the adequate high-humidity flow was obtained also by turning the heater for heating the photosensitive member OFF while the electrophotographic apparatus was stopped. From the above description, it was found that an electrophotographic photosensitive member having adequate energy-saving properties as well was obtained by setting the film-forming condition of the first surface layer and the second surface layer at the above described range, and adjusting the C/(Si+C) to the above described range.

EXAMPLE 2

Positively chargeable a-Si photosensitive members were prepared by forming each layer on the same conductive substrate as the above described one, by using a plasma treatment apparatus with the use of a high-frequency power source with an RF range as illustrated in FIG. 3, in conditions shown in the following Table 6 and Table 7. At this time, films of an electric-charge injection preventing layer, a photoconductive layer, a first surface layer and a second surface layer were formed (layer formation), in this order, and film-forming periods of time were controlled so that the film thicknesses of the layers could be respective values in Table 6. In addition, two electrophotographic photosensitive members were prepared for each film-forming condition.

TABLE 5

| | | Comp. ex. 1 | Comparative example 2 | | Ex. 1 | Comp. ex. 2 | Example 1 | | | Comparative example 2 | |
|---|---|---|---|---|---|---|---|---|---|---|---|
| | | Film-forming condition No. | | | | | | | | | |
| | | 5 | 6 | 7 | 1 | 8 | 2 | 3 | 4 | 9 | 10 |
| First surface layer | $S^1$ | — | 25 | 25 | 25 | 25 | 25 | 25 | 25 | 25 | 25 |
| | $C^1$ | — | 1400 | 1400 | 1400 | 1400 | 1400 | 1400 | 1400 | 1400 | 1400 |
| | $P^1$ | — | 400 | 400 | 400 | 400 | 400 | 400 | 400 | 400 | 400 |
| | $C^1/S^1$ | — | 56 | 56 | 56 | 56 | 56 | 56 | 56 | 56 | 56 |
| | C/(Si + C) | — | 0.73 | 0.73 | 0.73 | 0.73 | 0.73 | 0.73 | 0.73 | 0.73 | 0.73 |
| Second surface layer | $S^2$ | — | 25 | 25 | 25 | 25 | 25 | 25 | 25 | 25 | 25 |
| | $C^2$ | — | 1400 | 625 | 625 | 625 | 375 | 100 | 75 | 75 | 50 |
| | $P^2$ | — | 600 | 400 | 900 | 1000 | 600 | 600 | 600 | 450 | 800 |
| | $C^2/S^2$ | — | 56 | 25 | 25 | 25 | 15 | 4.0 | 3.0 | 3.0 | 2.0 |
| | C/(Si + C) | — | 0.76 | 0.69 | 0.80 | 0.82 | 0.66 | 0.54 | 0.50 | 0.47 | 0.50 |
| Surface layer | $S^3$ | 25 | — | — | — | — | — | — | — | — | — |
| | $C^3$ | 1400 | — | — | — | — | — | — | — | — | — |
| | $P^3$ | 400 | — | — | — | — | — | — | — | — | — |
| | $C^3/S^3$ | 56 | — | — | — | — | — | — | — | — | — |
| | C/(Si + C) | 0.73 | — | — | — | — | — | — | — | — | — |
| $(C^1/S^1)/(C^2/S^2)$ | | — | 1.0 | 2.2 | 2.2 | 2.2 | 3.7 | 14 | 19 | 19 | 28 |
| $C^1/C^2$ | | — | 1.0 | 2.2 | 2.2 | 2.2 | 3.7 | 14 | 19 | 19 | 28 |
| $P^2/P^1$ | | — | 1.5 | 1.0 | 2.3 | 2.5 | 1.5 | 1.5 | 1.5 | 1.1 | 2.0 |
| High-humidity flow | | C | C | C | B | B | A | A | A | A | A |
| Durability | | C | C | C | B | B | A | A | A | A | A |
| Sensitivity | | A | B | A | A | D | A | A | B | B | D |
| gradation properties | | A | A | A | A | A | A | A | A | B | A |

TABLE 6

| | electric-charge injection preventing layer | photo-conductive layer | first surface layer | second surface layer |
|---|---|---|---|---|
| gas type and flow rate | | | | |
| $SiH_4$ [mL/min (normal)] | 350 | 450 | 25 | 25 |
| $H_2$ [mL/min (normal)] | 750 | 2200 | | |
| $B_2H_6$ [ppm ] (w.r.t. $SiH_4$) | 1500 | 1 | | |
| NO [mL/min (normal)] | 10 | | | |
| $CH_4$ [mL/min (normal)] | | | Table 7 | 625 |
| inner pressure [Pa] | 40 | 80 | 50 | 55 |
| high-frequency power [W] | 400 | 800 | 400 | 600 |
| substrate temperature [° C.] | 260 | 260 | 260 | 260 |
| film thickness [μm] | 3 | 25 | 0.4 | 0.3 |

TABLE 7

| | film-forming condition No. | | | |
|---|---|---|---|---|
| | 11 | 12 | 13 | 14 |
| $CH_4$ [mL/min (normal)]: $C^1$ | 1500 | 1250 | 1000 | 625 |

The ratio C/(Si+C) of the electrophotographic photosensitive member prepared in Example 2 was determined, and the high-humidity flow, durability, gradation properties and sensitivity thereof were evaluated, similarly to those in Example 1. The result is shown in Table 9.

COMPARATIVE EXAMPLE 3

Every two positively chargeable a-Si photosensitive members were prepared by forming each layer on the same conductive substrate as the above described one, by using a plasma treatment apparatus with the use of a high-frequency power source illustrated in FIG. 3, which uses RF frequencies, in conditions shown in the above described Table 6, similarly to Example 2. However, the flow rate of $CH_4$ of a first surface layer is shown in Table 8.

TABLE 8

| | film-forming condition No. | |
|---|---|---|
| | 15 | 16 |
| $CH_4$ [mL/min (normal)]: $C^1$ | 1700 | 375 |

The ratio C/(Si+C) of the electrophotographic photosensitive member which had been prepared in Comparative example 3 was determined, and the high-humidity flow, durability, gradation properties and sensitivity thereof were evaluated, similarly to those in Example 1. The result is shown in Table 9.

The relating to C/(Si+C), high-humidity flow, durability, gradation properties and sensitivity of Example 2 and Comparative example 3 are shown in Table 9.

TABLE 9

| | | Comparative example 3 | Example 2 film-forming condition No. | | | | Comparative example 3 |
|---|---|---|---|---|---|---|---|
| | | 15 | 11 | 12 | 13 | 14 | 16 |
| First surface layer | $S^1$ | 25 | 25 | 25 | 25 | 25 | 25 |
| | $C^1$ | 1700 | 1500 | 1250 | 1000 | 625 | 375 |
| | $P^1$ | 400 | 400 | 400 | 400 | 400 | 400 |
| | $C^1/S^1$ | 68 | 60 | 50 | 40 | 25 | 15 |
| | C/(Si + C) | 0.76 | 0.75 | 0.72 | 0.71 | 0.68 | 0.64 |
| second surface layer | $S^2$ | 25 | 25 | 25 | 25 | 25 | 25 |
| | $C^2$ | 625 | 625 | 625 | 625 | 625 | 625 |
| | $P^2$ | 600 | 600 | 600 | 600 | 600 | 600 |
| | $C^2/S^2$ | 25 | 25 | 25 | 25 | 25 | 25 |
| | C/(Si + C) | 0.74 | 0.74 | 0.74 | 0.74 | 0.74 | 0.74 |
| $(C^1/S^1)/(C^2/S^2)$ | | 2.7 | 2.4 | 2.0 | 1.6 | 1.0 | 0.6 |
| $C^1/C^2$ | | 2.7 | 2.4 | 2.0 | 1.6 | 1.0 | 0.6 |
| $P^2/P^1$ | | 1.5 | 1.5 | 1.5 | 1.5 | 1.5 | 1.5 |
| high-humidity flow | | B | B | B | B | B | B |
| Durability | | B | B | B | B | B | B |
| Sensitivity | | D | A | A | B | B | D |
| gradation properties | | A | A | A | A | A | A |

As is clear from the results in Table 9, an electrophotographic photosensitive member having an adequate sensitivity was obtained by adjusting the film-forming conditions of the first surface layer and the second surface layer so that $C^2/S^2 \leqq C^1/S^1 \leqq 60$ and $P^2 > P^1$ could be satisfied and C/(Si+C) relating to the first surface layer and C/(Si+C) relating to the second surface layer could be $0.50 \leqq C/(Si+C) \leqq 0.80$. Furthermore, the electrophotographic photosensitive member having a particularly adequate sensitivity was obtained by controlling the film-forming conditions of the first surface layer and the second surface layer to a range expressed by $C^1/C^2 \geqq 2$.

EXAMPLE 3

Positively chargeable a-Si photosensitive members were prepared by forming each layer on the same conductive substrate as the above described one, by using a plasma treatment apparatus with the use of a high-frequency power source illustrated in FIG. 3, which uses RF frequencies, in conditions shown in the following Table 10 and Table 11. At this time, films of an electric-charge injection preventing layer, a photoconductive layer, a first surface layer and a second surface layer were formed (layer formation) in this order, and a film-forming period of time was controlled so that the film thicknesses of the layers could be respective values in Table 10. In addition, two electrophotographic photosensitive members were prepared for each film-forming condition.

In the present example, a second joining layer is provided in between the first surface layer and the second surface layer. The electrophotographic photosensitive member (positively chargeable a-Si photosensitive member 1100) in the present example has a structure in which a light receiving layer 1102 and a surface layer 1105 are provided on a conductive substrate 1101 in this order, as is illustrated in FIG. 1B. The light receiving layer 1102 has a lower electric-charge injection preventing layer 1103, which is made from silicon atoms of a base material (lower electric-charge injection preventing layer formed from amorphous material containing silicon atom), and a photoconductive layer 1104 which is made from silicon atoms of a base material (photoconductive layer formed from amorphous material containing silicon atom), provided in this order. The surface layer 1105 has a first surface layer 1106 which is made from silicon atoms and carbon atoms of a base material (first surface layer formed from amorphous material containing silicon atom and carbon atom), a second joining region 1109 and a second surface layer 1107, provided in this order.

TABLE 10

| | electric-charge injection preventing layer | photoconductive layer | first surface layer | second joining region | second surface layer |
|---|---|---|---|---|---|
| gas type and flow rate | | | | | |
| $SiH_4$ [mL/min (normal)] | 350 | 450 | 30 | 30→25 | 25 |
| $H_2$ [mL/min (normal)] | 750 | 2200 | | | |
| $B_2H_6$ [ppm] (w.r.t. $SiH_4$) | 1500 | 1 | | | |
| NO [mL/min (normal)] | 10 | | | | |
| $CH_4$ [mL/min (normal)] | | | 1000 | 1000→390 | 375 |
| inner pressure [Pa] | 40 | 80 | 50 | 50 | 55 |
| high-frequency power [W] | 400 | 800 | 300 | 300 | Table 11 |
| substrate temperature [° C.] | 260 | 260 | 260 | 260 | 260 |
| film thickness [μm] | 3 | 25 | 0.39 | 0.01 | 0.3 |

TABLE 11

| | film-forming condition No. | | |
|---|---|---|---|
| | 17 | 18 | 19 |
| high-frequency power [W]: $P^2$ | 600 | 900 | 1000 |

The ratio C/(Si+C) of the electrophotographic photosensitive member which had been prepared in Example 3 was determined, and the high-humidity flow, durability, gradation properties and sensitivity thereof were evaluated, similarly to those in Example 1. The result is shown in Table 13.

COMPARATIVE EXAMPLE 4

Every two positively chargeable a-Si photosensitive members were prepared by forming each layer on the same conductive substrate as the above described one, by using a plasma treatment apparatus with the use of a high-frequency power source illustrated in FIG. 3, which uses RF frequencies, in conditions shown in the above described Table 10, similarly to Example 3. However, the high-frequency power for the second surface layer is shown in Table 12.

TABLE 12

| | film-forming condition No. | |
|---|---|---|
| | 20 | 21 |
| high-frequency power [W]: $P^2$ | 200 | 300 |

The ratio C/(Si+C) of the electrophotographic photosensitive member which had been prepared in Comparative example 4 was determined, and the high-humidity flow, durability, gradation properties and sensitivity thereof were evaluated, similarly to those in Example 1. The results are shown in Table 13.

The results relating to C/(Si+C), high-humidity flow, durability, gradation properties and sensitivity of Example 3 and Comparative example 4 are shown in Table 13.

TABLE 13

| | | Comparative example 4 | | Example 3 | | |
|---|---|---|---|---|---|---|
| | | film-forming condition No. | | | | |
| | | 20 | 21 | 17 | 18 | 19 |
| first surface layer | $S^1$ | 30 | 30 | 30 | 30 | 30 |
| | $C^1$ | 1000 | 1000 | 1000 | 1000 | 1000 |
| | $P^1$ | 300 | 300 | 300 | 300 | 300 |
| | $C^1/S^1$ | 33 | 33 | 33 | 33 | 33 |
| | C/(Si + C) | 0.69 | 0.69 | 0.69 | 0.69 | 0.69 |
| second surface layer | $S^2$ | 25 | 25 | 25 | 25 | 25 |
| | $C^2$ | 375 | 375 | 375 | 375 | 375 |
| | $P^2$ | 200 | 300 | 600 | 900 | 1000 |
| | $C^2/S^2$ | 15 | 15 | 15 | 15 | 15 |
| | C/(Si + C) | 0.59 | 0.61 | 0.66 | 0.70 | 0.71 |

TABLE 13-continued

| | Comparative example 4 | | Example 3 | | |
|---|---|---|---|---|---|
| | film-forming condition No. | | | | |
| | 20 | 21 | 17 | 18 | 19 |
| $(C^1/S^1)/(C^2/S^2)$ | 2.2 | 2.2 | 2.2 | 2.2 | 2.2 |
| $C^1/C^2$ | 2.7 | 2.7 | 2.7 | 2.7 | 2.7 |
| $P^2/P^1$ | 0.7 | 1.0 | 2.0 | 3.0 | 3.3 |
| high-humidity flow | C | C | A | A | A |
| durability | C | C | A | A | A |
| sensitivity | A | A | A | A | B |
| gradation properties | A | A | A | A | A |

As is clear from the results in Table 13, an electrophotographic photosensitive member superior in high-humidity flow, abrasion amount, sensitivity and gradation properties was obtained by adjusting the film-forming conditions of a first surface layer and a second surface layer so that $3 \leqq C^2/S^2 \leqq 25$, $C^2/S^2 \leqq C^1/S^1 \leqq 60$ and $P^2 > P^1$ could be satisfied and C/(Si+C) relating to the first surface layer and C/(Si+C) relating to the second surface layer could satisfy $0.50 \leqq C/(Si+C) \leqq 0.80$. Furthermore, the electrophotographic photosensitive member having a particularly adequate sensitivity was obtained by controlling the film-forming conditions of the first surface layer and the second surface layer to a range expressed by $1 < P^2/P^1 \leqq 3$.

In addition, the adequate high-humidity flow was obtained even if a heater for heating the photosensitive member was turned OFF while the electrophotographic apparatus was stopped. From the above description, it was found that an electrophotographic photosensitive member having adequate energy-saving properties as well was obtained by setting the film-forming conditions of the first surface layer and the second surface layer at the above described range, and adjusting the C/(Si+C) to the above described range.

EXAMPLE 4

Positively chargeable a-Si photosensitive members were prepared by forming each layer on the same conductive substrate as the above described one, by using a plasma treatment apparatus with the use of a high-frequency power source illustrated in FIG. 3, which uses RF frequencies, in conditions shown in the following Table 14 and Table 15. At this time, films of an electric-charge injection preventing layer, a photoconductive layer, a first surface layer and a second surface layer were formed (layer formation) in this order, and a film-forming period of time was controlled so that the film thicknesses of the layers could be respective values in Table 14. In addition, two electrophotographic photosensitive members were prepared for each film-forming condition.

The flow rate of $CH_4$ and high-frequency electric power which are described in Table 14 will now be described with reference to a film-forming condition No. 23. The description of the flow rate of $CH_4$ in a first joining region "0→Table 15" means that the flow rate was continuously increased from 0 [mL/min (normal)] to 600 [mL/min (normal)] which is a condition in a film-forming condition No. 23 in Table 15. Similarly, the description of the high-frequency power "300 W→Table 15" means that the high-frequency power was continuously increased from 300 W to 650 W which is a condition in the film-forming condition No. 23 in Table 15.

Similarly, in the first surface layer, the flow rate of $CH_4$ and the high-frequency power are 600 [mL/min (normal)] and 650 W respectively which are described in Table 15. In the second joining region, the description on the flow rate of $CH_4$ means that the flow rate was continuously decreased from 600 [mL/min (normal)] to 300 [mL/min (normal)], and the description on the high-frequency power means that the high-frequency power was continuously increased from 650 W to 700 W.

TABLE 14

| | electric-charge injection preventing layer | photo-conductive layer | first joining region | first surface layer | second joining region | second surface layer |
|---|---|---|---|---|---|---|
| gas type and flow rate | | | | | | |
| $SiH_4$ [mL/min (normal)] | 350 | 450 | 450→25 | 25 | 25→30 | 30 |
| $H_2$ [mL/min (normal)] | 750 | 2200 | 2000→0 | | | |
| $B_2H_6$ [ppm] (w.r.t. $SiH_4$) | 1500 | 1 | 1→0 | | | |
| NO [mL/min (normal)] | 10 | | | | | |
| $CH_4$ [mL/min (normal)] | | | 0→Table 15 | Table 15 | Table 15→300 | 300 |
| inner pressure [Pa] | 40 | 80 | 80→50 | 50 | 50→55 | 55 |
| high-frequency power [W] | 400 | 800 | 300→Table 15 | Table 15 | Table 15 | 700 |
| substrate temperature [° C.] | 260 | 260 | 260 | 260 | 260 | 260 |
| film thickness [μm] | 3 | 25 | 0.01 | 0.38 | 0.01 | 0.3 |

TABLE 15

| | film-forming condition No. | | | | |
|---|---|---|---|---|---|
| | 22 | 23 | 24 | 25 | 26 |
| $CH_4$ [mL/min (normal)]: $C^1$ | 600 | 550 | 400 | 300 | 270 |
| high-frequency power [W]: $P^1$ | 650 | 600 | 450 | 350 | 350 |

The ratio C/(Si+C) of the electrophotographic photosensitive member which had been prepared in Example 4 was determined, and the high-humidity flow, durability, gradation properties and sensitivity thereof were evaluated, similarly to those in Example 1. The results are shown in Table 16.

TABLE 16

| | | Example 4 film-forming condition No. | | | | |
|---|---|---|---|---|---|---|
| | | 22 | 23 | 24 | 25 | 26 |
| first surface layer | $S^1$ | 25 | 25 | 25 | 25 | 25 |
| | $C^1$ | 600 | 550 | 400 | 300 | 270 |
| | $P^1$ | 650 | 600 | 450 | 350 | 350 |
| | $C^1/S^1$ | 24 | 22 | 16 | 12 | 11 |
| | C/(Si + C) | 0.73 | 0.71 | 0.66 | 0.62 | 0.61 |
| second surface layer | $S^2$ | 30 | 30 | 30 | 30 | 30 |
| | $C^2$ | 300 | 300 | 300 | 300 | 300 |
| | $P^2$ | 700 | 700 | 700 | 700 | 700 |
| | $C^2/S^2$ | 10 | 10 | 10 | 10 | 10 |
| | C/(Si + C) | 0.64 | 0.64 | 0.64 | 0.64 | 0.64 |
| $(C^1/S^1)/(C^2/S^2)$ | | 2.4 | 2.2 | 1.6 | 1.2 | 1.1 |
| $C^1/C^2$ | | 2.0 | 1.8 | 1.3 | 1.0 | 0.9 |
| $P^2/P^1$ | | 1.1 | 1.2 | 1.6 | 2.0 | 2.0 |
| high-humidity flow | | A | A | A | A | A |
| Durability | | A | A | A | A | A |
| sensitivity | | A | B | B | B | C |
| gradation properties | | A | A | A | A | A |

As is clear from the results in Table 16, an electrophotographic photosensitive member superior in high-humidity flow, abrasion amount, sensitivity and gradation properties was obtained by adjusting the film-forming conditions of a first surface layer and a second surface layer so that $3 \leqq C^2/S^2 \leqq 25$, $C^2/S^2 \leqq C^1/S^1 \leqq 60$ and $P^2 > P^1$ could be satisfied and C/(Si+C) relating to the first surface layer and C/(Si+C) relating to the second surface layer could satisfy $0.50 \leqq C/(Si+C) \leqq 0.80$. Furthermore, the electrophotographic photosensitive member having adequate sensitivity was obtained by controlling the film-forming conditions of the first surface layer and the second surface layer to a range expressed by $C^1 \geqq C^2$, in other words, $1 \leqq C^1/C^2$. Furthermore, the electrophotographic photosensitive member having a particularly adequate sensitivity was obtained by controlling the film-forming conditions of the first surface layer and the second surface layer to a range expressed by $2 \leqq C^1/C^2$.

EXAMPLE 5

Positively chargeable a-Si photosensitive members were prepared by forming each layer on the same conductive substrate as the above described one, by using a plasma treatment apparatus with the use of a high-frequency power source illustrated in FIG. 3, which uses RF frequencies, in conditions shown in the following Table 17 and Table 18. At this time, films of an electric-charge injection preventing layer, a photoconductive layer, a first surface layer and a second surface layer were formed (layer formation) in this order, and a film-forming period of time was controlled so that the film thicknesses of the layers could be respective values in Table 17 and Table 18. In addition, two electrophotographic photosensitive members were prepared for each film-forming condition.

TABLE 17

| | electric-charge injection preventing layer | photo-conductive layer | first surface layer | second surface layer |
|---|---|---|---|---|
| gas type and flow rate | | | | |
| $SiH_4$ [mL/min (normal)] | 350 | 450 | 25 | 25 |
| $H_2$ [mL/min (normal)] | 750 | 2200 | | |
| $B_2H_6$ [ppm] (w.r.t. $SiH_4$) | 1500 | 1 | | |

TABLE 17-continued

| | electric-charge injection preventing layer | photo-conductive layer | first surface layer | second surface layer |
|---|---|---|---|---|
| NO [mL/min (normal)] | 10 | | | |
| $CH_4$ [mL/min (normal)] | | | 1400 | 375 |
| inner pressure [Pa] | 40 | 80 | 50 | 55 |
| high-frequency power [W] | 400 | 800 | 400 | 800 |
| substrate temperature [° C.] | 260 | 260 | 260 | 260 |
| film thickness [μm] | 3 | 25 | Table 18 | Table 18 |

TABLE 18

| | film-forming condition No. | | | | | | |
|---|---|---|---|---|---|---|---|
| | 27 | 28 | 29 | 30 | 31 | 32 | 33 |
| film thickness of first surface layer (μm) | 0.05 | 0.10 | 0.10 | 0.50 | 0.80 | 0.90 | 1.20 |
| film thickness of second surface layer (μm) | 0.20 | 0.20 | 0.40 | 0.40 | 0.50 | 0.60 | 0.70 |

The ratio C/(Si+C) of the electrophotographic photosensitive member which had been prepared in Example 5 was determined, and the high-humidity flow, durability, gradation properties and sensitivity thereof were evaluated, similarly to those in Example 1. A pressure scar was also evaluated on the evaluation condition which will be described below.

(Evaluation of Pressure Scar)

The pressure scar was evaluated with the use of a scratch tester (Scratching TESTER HEIDON-14: product made by HEIDOn) at three points (0 mm and ±90 mm with respect to center in longitudinal direction of electrophotographic photosensitive member) in a longitudinal direction at an arbitrary point in a peripheral direction of an electrophotographic photosensitive member. The pressure scar was measured with the use of the scratch tester on conditions that the scratch distance was 30 mm, a needle was made from a diamond having the diameter of 0.1 mm and the tip angle of 90 degrees, the moving speed of the needle was 50 mm/min, the needle moved once for each measurement and the loads were 100 g, 150 g and 200 g.

Subsequently, the electrophotographic photosensitive member after having been scratched was arranged in iR-5065 which is a digital electrophotographic apparatus made by Canon Inc., and a halftone image having a reflection density of 1.0 was output in the environment of the temperature of 22° C. and the relative humidity of 50%. The pressure scar was evaluated by visually confirming whether a blank area was formed in a scratched portion from the output image.

Class (A) means that no blank area was formed in scratched portions made by any load of 100 g, 150 g and 200 g.

Class (B) means that no blank area was formed in scratched portions made by the loads of 100 g and 150 g, but the blank area was observed in a scratched portion made by the load of 200 g.

Class (C) means that no blank area was formed in a scratched portion made by the load of 100 g, but the blank area was observed in scratched portions made by the loads of 150 g and 200 g.

Class (D) means that the blank area was observed in scratched portions made by any load of 100 g, 150 g and 200 g.

The results relating to the high-humidity flow, durability, gradation properties sensitivity, and pressure scar of Example 5 are shown in Table 19.

TABLE 19

| | | Example 5 film-forming condition No. | | | | | | |
|---|---|---|---|---|---|---|---|---|
| | | 27 | 28 | 29 | 30 | 31 | 32 | 33 |
| first surface layer | $S^1$ | 25 | 25 | 25 | 25 | 25 | 25 | 25 |
| | $C^1$ | 1400 | 1400 | 1400 | 1400 | 1400 | 1400 | 1400 |
| | $P^1$ | 400 | 400 | 400 | 400 | 400 | 400 | 400 |
| | $C^1/S^1$ | 56 | 56 | 56 | 56 | 56 | 56 | 56 |
| | C/(Si + C) | 0.73 | 0.73 | 0.73 | 0.73 | 0.73 | 0.73 | 0.73 |
| | film thickness $d^1$ | 0.05 | 0.10 | 0.10 | 0.50 | 0.80 | 0.90 | 1.20 |
| second surface layer | $S^2$ | 25 | 25 | 25 | 25 | 25 | 25 | 25 |
| | $C^2$ | 375 | 375 | 375 | 375 | 375 | 375 | 375 |
| | $P^2$ | 800 | 800 | 800 | 800 | 800 | 800 | 800 |
| | $C^2/S^2$ | 15 | 15 | 15 | 15 | 15 | 15 | 15 |
| | C/(Si + C) | 0.69 | 0.69 | 0.69 | 0.69 | 0.69 | 0.69 | 0.69 |
| | film thickness $d^2$ | 0.20 | 0.20 | 0.40 | 0.40 | 0.50 | 0.60 | 0.70 |
| $(C^1/S^1)/(C^2/S^2)$ | | 3.7 | 3.7 | 3.7 | 3.7 | 3.7 | 3.7 | 3.7 |
| $C^1/C^2$ | | 3.7 | 3.7 | 3.7 | 3.7 | 3.7 | 3.7 | 3.7 |
| $P^2/P^1$ | | 2.0 | 2.0 | 2.0 | 2.0 | 2.0 | 2.0 | 2.0 |
| $d^1 + d^2$ | | 0.25 | 0.30 | 0.50 | 0.90 | 1.3 | 1.5 | 1.9 |
| high-humidity flow | | A | A | A | A | A | A | A |
| abrasion amount | | B | B | A | A | A | A | A |
| sensitivity | | A | A | A | A | A | A | B |
| gradation properties | | A | A | A | A | A | A | A |
| Pressure scar | | C | B | A | A | A | A | A |

It was found from the results in Table 19 that a superior electrophotographic photosensitive member was obtained in all of the film-forming conditions 28 to 34 which were adjusted so that $3 \leqq C^2/S^2 \leqq 25$, $P^2 > P^1$, $C^1/S^1 \leqq 60$ and $1 \leqq (C^1/S^1)/(C^2/S^2)$ could be satisfied, and C/(Si+C) relating to the first surface layer and C/(Si+C) relating to the second surface layer could satisfy $0.50 \leqq C/(Si+C) \leqq 0.80$. It was also found that the electrophotographic photosensitive member could acquire particularly superior sensitivity and keep the pressure scar and abrasive amount at an adequate state by controlling the sum of the film thicknesses of the first surface layer and the second surface layer to 0.30 μm or more and 1.50 μm or less. Furthermore, it was found that the electrophotographic photosensitive member having a particularly adequate quality in any of the sensitivity, pressure scar and abrasive amount was obtained by controlling the sum of the film thicknesses of the first surface layer and the second surface layer to 0.30 μm or more and 1.50 μm or less.

EXAMPLE 6

Positively chargeable a-Si photosensitive members were prepared by forming each layer on the same conductive substrate as the above described one, by using a plasma treatment apparatus with the use of a high-frequency power source illustrated in FIG. 3, which uses RF frequencies, in conditions shown in the following Table 20 and Table 21. At this time, films of an electric-charge injection preventing layer, a photoconductive layer, a first surface layer and a second surface layer were formed (layer formation) in this order, and a film-forming period of time was controlled so that the film thicknesses of the layers could be respective values in Table 20 and Table 21. In addition, two electrophotographic photosensitive members were prepared for each film-forming condition.

TABLE 20

| | electric-charge injection preventing layer | photo-conductive layer | first surface layer | second surface layer |
|---|---|---|---|---|
| Gas type and flow rate | | | | |
| $SiH_4$ [mL/min (normal)] | 350 | 450 | 25 | 25 |
| $H_2$ [mL/min (normal)] | 750 | 2200 | | |
| $B_2H_6$ [ppm] (w.r.t. $SiH_4$) | 1500 | 1 | | |
| NO [mL/min (normal)] | 10 | | | |
| $CH_4$ [mL/min (normal)] | | | 750 | 250 |
| inner pressure [Pa] | 40 | 80 | 50 | 55 |
| high-frequency power [W] | 400 | 800 | 400 | 800 |
| substrate temperature [° C.] | 260 | 260 | 260 | 260 |
| film thickness [μm] | 3 | 25 | Table 21 | Table 21 |

TABLE 21

| | film-forming condition No. | | | | | |
|---|---|---|---|---|---|---|
| | 34 | 35 | 36 | 37 | 38 | 39 |
| film thickness of first surface layer (μm) | 0.20 | 0.20 | 0.20 | 0.20 | 0.20 | 0.20 |
| film thickness of second surface layer (μm) | 0.10 | 0.20 | 0.50 | 0.90 | 0.10 | 1.30 |

The ratio C/(Si+C) of the electrophotographic photosensitive member which had been prepared in Example 6 was determined, the high-humidity flow, durability, gradation properties and sensitivity thereof were evaluated, similarly to those in Example 1, and the pressure scar thereof was evaluated similarly to Example 5. The results are shown in Table 22.

TABLE 22

| | | Example 6 film-forming condition No. | | | | | |
|---|---|---|---|---|---|---|---|
| | | 34 | 35 | 36 | 37 | 38 | 39 |
| First surface layer | $S^1$ | 25 | 25 | 25 | 25 | 25 | 25 |
| | $C^1$ | 750 | 750 | 750 | 750 | 750 | 750 |
| | $P^1$ | 400 | 400 | 400 | 400 | 400 | 400 |
| | $C^1/S^1$ | 30 | 30 | 30 | 30 | 30 | 30 |
| | C/(Si + C) | 0.71 | 0.71 | 0.71 | 0.71 | 0.71 | 0.71 |
| | Film thickness $d^1$ | 0.20 | 0.20 | 0.20 | 0.20 | 0.20 | 0.20 |
| second surface layer | $S^2$ | 25 | 25 | 25 | 25 | 25 | 25 |
| | $C^2$ | 250 | 250 | 250 | 250 | 250 | 250 |
| | $P^2$ | 800 | 800 | 800 | 800 | 800 | 800 |
| | $C^2/S^2$ | 10 | 10 | 10 | 10 | 10 | 10 |
| | C/(Si + C) | 0.64 | 0.64 | 0.64 | 0.64 | 0.64 | 0.64 |
| | film thickness $d^2$ | 0.10 | 0.20 | 0.50 | 0.90 | 1.00 | 1.30 |
| $(C^1/S^1)/(C^2/S^2)$ | | 3.0 | 3.0 | 3.0 | 3.0 | 3.0 | 3.0 |
| $C^1/C^2$ | | 3.0 | 3.0 | 3.0 | 3.0 | 3.0 | 3.0 |
| $P^2/P^1$ | | 2.0 | 2.0 | 2.0 | 2.0 | 2.0 | 2.0 |
| $d^1 + d^2$ | | 0.30 | 0.40 | 0.70 | 1.1 | 1.2 | 1.5 |
| High-humidity flow | | A | A | A | A | A | A |
| abrasion amount | | C | B | A | A | A | A |
| Sensitivity | | A | A | A | A | A | B |
| gradation properties | | A | A | A | A | A | A |
| pressure scar | | B | B | A | A | A | A |

As is clear from the results in Table 22, a superior electrophotographic photosensitive member was obtained in all of the film-forming conditions 35 to 40 which were adjusted so that $3 \leqq C^2/S^2 \leqq 25$, $P^2 > P^1$, $C^1/S^1 \leqq 60$ and $1 \leqq (C^1/S^1)/(C^2/S^2)$ could be satisfied, and C/(Si+C) relating to the first surface layer and C/(Si+C) relating to the second surface layer could satisfy $0.50 \leqq C/(Si+C) \leqq 0.80$. It was also found that the electrophotographic photosensitive member could acquire particularly superior sensitivity and keep the pressure scar and abrasive amount at an adequate state by controlling the film thickness of the second surface layer to 0.20 μm or more and 1.00 μm or less.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2008-192057, filed Jul. 25, 2008, and No. 2009-160400, filed Jul. 7, 2009, which are hereby incorporated by reference herein in their entirety.

What is claimed is:

1. A method for manufacturing an electrophotographic photosensitive member, which mounts a conductive substrate in a reaction vessel that can be evacuated, supplies a source gas into the reaction vessel and introduces a high-frequency power to form a deposited film on the conductive substrate, comprising in the following order:

forming a photoconductive layer formed from an amorphous material containing silicon atoms on the conductive substrate;

forming a first surface layer formed from an amorphous material containing silicon atoms and carbon atoms; and forming a second surface layer formed from an amorphous material containing silicon atoms and carbon atoms as a layer in a top surface side of the electrophotographic photosensitive member, wherein when flow rates of $CH_4$ and $SiH_4$ to be supplied into the reaction vessel in forming the first surface layer are defined as $C^1$ and $S^1$ and a high-frequency power to be introduced into the reaction vessel is defined as $P^1$, and when flow rates of $CH_4$ and $SiH_4$ to be supplied into the reaction vessel in forming the second surface layer are defined as $C^2$ and $S^2$ and a high-frequency power to be introduced into the reaction vessel is defined as $P^2$, the first surface layer and the second surface layer are formed while supplying the source gas into the reaction vessel so that $C^2/S^2$ is 3 or more and 25 or less and $C^1/S^1$ is $C^2/S^2$ or more and 60 or less, and while adjusting the high-frequency power so that $P^2 > P^1$ can be satisfied, and so that both a ratio of the number of atoms of the carbon atoms with respect to the sum of the number of atoms of the silicon atoms and the carbon atoms contained in the first surface layer and the ratio of the number of atoms of the carbon atoms with respect to the sum of the number of atoms of the silicon atoms and the carbon atoms contained in the second surface layer can be 0.50 or more and 0.80 or less.

2. The method for manufacturing the electrophotographic photosensitive member according to claim 1, wherein the $C^2/S^2$ is controlled so as to satisfy $4 \leqq C^2/S^2 \leqq 15$.

3. The method for manufacturing the electrophotographic photosensitive member according to claim 1, wherein the first surface layer and the second surface layer are formed in a condition that the $C^1$ and the $C^2$ satisfy $C^1 \geqq C^2$.

4. The method for manufacturing the electrophotographic photosensitive member according to claim 1, wherein the first surface layer and the second surface layer are formed in a condition that the $P^1$ and the $P^2$ satisfy $1 < P^2/P^1 \leqq 3$.

5. The method for manufacturing the electrophotographic photosensitive member according to claim 1, wherein the first surface layer and the second surface layer are formed in a condition that the $C^1$ and the $C^2$ satisfy $C^1/C^2 \geqq 2$.

6. The method for manufacturing the electrophotographic photosensitive member according to claim 1, wherein the film thickness of the second surface layer is 0.20 μm or more and 1.00 μm or less, and the sum of the film thicknesses of the first surface layer and the second surface layer is 0.30 μm or more and 1.50 μm or less.

* * * * *